US011535467B2

(12) United States Patent
Nishii

(10) Patent No.: US 11,535,467 B2
(45) Date of Patent: Dec. 27, 2022

(54) SHEET GUIDING DEVICE AND IMAGE FORMING APPARATUS INCORPORATING THE SHEET GUIDING DEVICE

(71) Applicant: Toshikane Nishii, Kanagawa (JP)

(72) Inventor: Toshikane Nishii, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 175 days.

(21) Appl. No.: 16/922,424

(22) Filed: Jul. 7, 2020

(65) Prior Publication Data

US 2021/0032054 A1 Feb. 4, 2021

(30) Foreign Application Priority Data

Jul. 31, 2019 (JP) ..... JP2019-141811

(51) Int. Cl.

*B65H 5/06* (2006.01)
*B65H 3/06* (2006.01)
*B65H 1/20* (2006.01)

(52) U.S. Cl.

CPC ..... *B65H 3/0661* (2013.01); *B65H 1/20* (2013.01); *B65H 5/068* (2013.01); *B65H 2402/45* (2013.01)

(58) Field of Classification Search

CPC ..... B65H 2402/45; B65H 2402/441; B65H 2601/321; B65H 3/0661

See application file for complete search history.

(56) References Cited

U.S. PATENT DOCUMENTS

| | | | | |
|---|---|---|---|---|
| 9,061,850 | B2 * | 6/2015 | Watatani | G03G 15/70 |
| 11,099,514 | B2 * | 8/2021 | Kamikawa | G03G 21/1633 |
| 11,123,998 | B2 * | 9/2021 | Otsuka | G03G 21/1623 |
| 2011/0127707 | A1 | 6/2011 | Honda et al. | |
| 2011/0204556 | A1 | 8/2011 | Takahira et al. | |
| 2011/0285076 | A1 | 11/2011 | Fujiwara et al. | |
| 2011/0291353 | A1 | 12/2011 | Fujiwara et al. | |
| 2012/0104685 | A1 | 5/2012 | Nishii et al. | |
| 2012/0146281 | A1 | 6/2012 | Nishii et al. | |
| 2013/0004221 | A1 | 1/2013 | Honda et al. | |

(Continued)

FOREIGN PATENT DOCUMENTS

| | | |
|---|---|---|
| JP | 11-349170 | 12/1999 |
| JP | 2001-192140 | 7/2001 |

(Continued)

*Primary Examiner* — Howard J Sanders

(74) *Attorney, Agent, or Firm* — Harness, Dickey & Pierce, P.L.C.

(57) ABSTRACT

A sheet guiding device includes a cover unit, a swing guide, a link member, and a contact member. The cover unit is configured to be openably disposed on a housing of an image forming apparatus. The swing guide is configured to move between a guide position at which the swing guide is open to guide a sheet and a retracted position at which the swing guide is closed. The swing guide is configured to move from the retracted position to the guide position along with closing movement of the cover unit. The link member has one end configured to be held by the housing and an opposite end engaged with the swing guide. The contact member is disposed on the cover unit. The contact member is configured to contact the link member to rotate the link member in the closing movement of the cover unit.

20 Claims, 27 Drawing Sheets

(56) References Cited

U.S. PATENT DOCUMENTS

| | | | | |
|---|---|---|---|---|
| 2013/0106050 | A1 | 5/2013 | Nishii et al. | |
| 2013/0164066 | A1* | 6/2013 | Nakamura | B65H 5/062 271/225 |
| 2014/0091518 | A1 | 4/2014 | Nishii et al. | |
| 2014/0239578 | A1 | 8/2014 | Honda et al. | |
| 2015/0014919 | A1 | 1/2015 | Nakamura et al. | |
| 2015/0259164 | A1 | 9/2015 | Horita et al. | |
| 2016/0109841 | A1 | 4/2016 | Horita et al. | |
| 2016/0167904 | A1 | 6/2016 | Nishii | |
| 2016/0378042 | A1 | 12/2016 | Tanaka et al. | |

FOREIGN PATENT DOCUMENTS

| | | |
|---|---|---|
| JP | 2004-272289 | 9/2004 |
| JP | 2016-179864 | 10/2016 |

* cited by examiner

SHEET GUIDING DEVICE AND IMAGE FORMING APPARATUS INCORPORATING THE SHEET GUIDING DEVICE

CROSS-REFERENCE TO RELATED APPLICATION

This patent application is based on and claims priority pursuant to 35 U.S.C. § 119(a) to Japanese Patent Application No. 2019-141811, filed on Jul. 31, 2019, in the Japan Patent Office, the entire disclosure of which is hereby incorporated by reference herein.

BACKGROUND

Technical Field

This disclosure relates to a sheet guiding device and an image forming apparatus incorporating the sheet guiding device.

Discussion of the Background Art

Various types of sheet guiding devices are known to include a cover unit openably attached to a housing of an image forming apparatus and a swing guide to swing between a guide position at which the swing guide guides a sheet and a retracted position at which the swing guide is retracted from the guide position, where the sheet guiding device swings the swing guide from the retracted position to the guide position along with movement of the cover unit to close the cover unit.

SUMMARY

At least one aspect of this disclosure provides a sheet guiding device including a cover unit, a swing guide, a link member, and a contact member. The cover unit is configured to be openably disposed on a housing of an image forming apparatus. The swing guide is configured to move between a guide position at which the swing guide is open to guide a sheet and a retracted position at which the swing guide is closed. The swing guide is configured to move from the retracted position to the guide position along with closing movement of the cover unit. The link member has one end configured to be held by the housing and an opposite end engaged with the swing guide. The contact member is disposed on the cover unit. The contact member is configured to contact the link member to rotate the link member in the closing movement of the cover unit.

Further, at least one aspect of this disclosure provides an image forming apparatus including the housing and the above-described sheet guiding device configured to guide the sheet.

BRIEF DESCRIPTION OF THE SEVERAL VIEWS OF THE DRAWINGS

An exemplary embodiment of this disclosure will be described in detail based on the following figured, wherein:

FIGS. 16A and 6B are diagrams illustrating a schematic configuration of the link member and the swing guide;

Figure 1:
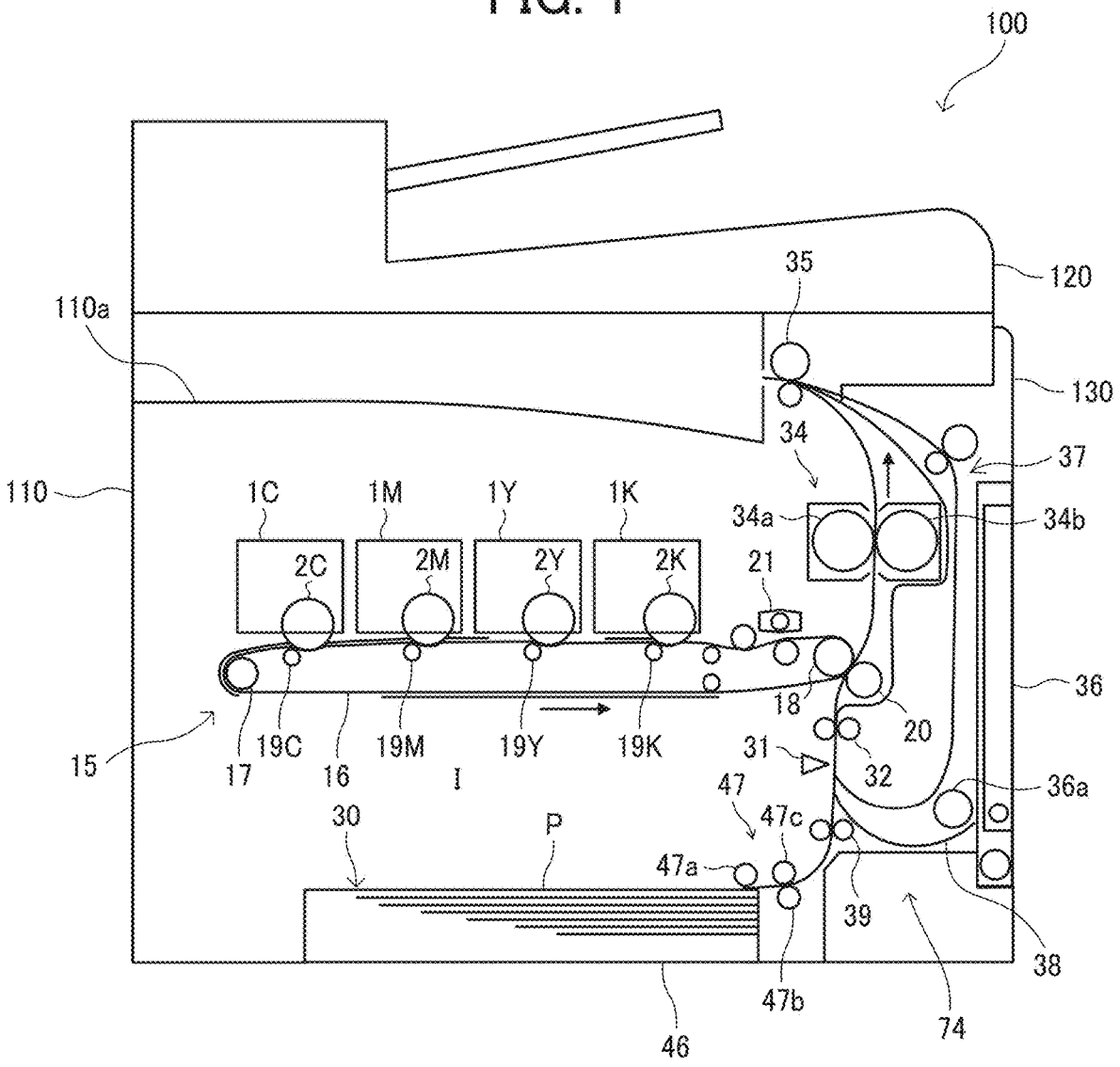
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

In the following description, the term "image forming apparatus" refers to an image forming apparatus that performs image formation by attaching developer or ink to a medium such as paper, OHP sheet, yarn, fiber, cloth, leather, metal, plastic, glass, wood, ceramics and the like. Further, it is to be noted that the term "image formation" indicates an action for providing (i.e., printing) not only an image having meanings such as texts and figures on a recording medium but also an image having no meaning such as patterns on a recording medium. Further, it is to be noted that the term "sheet" is not limited to indicate a paper sheet but also includes OHP transparency sheet, cloth, and a material which is called as a recording target medium, a recording medium, a recording sheet, or a recording paper, and is used to which the developer or ink is attracted. In the above-described embodiment, a sheet is described as the "paper sheet", and the dimensions, the materials, the shapes, the relative arrangements, and the like described for the respective component are examples, and the scope of the present invention is not intended to be limited thereto unless otherwise particularly specified. Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

It is to be noted that the present embodiment describes an electrophotographic image forming apparatus to which a sheet guiding device according to the present embodiment of this disclosure is applied. However, the image forming method of the electrophotographic image forming apparatus may be other types such as an inkjet method.

FIG. 1 is a diagram illustrating a schematic configuration of an image forming apparatus 100 according to an embodiment of this disclosure.

The image forming apparatus 100 includes a main part and a scanning part to be mounted on the main part. Hereinafter, the main part of the image forming apparatus 100 is referred to as a printer 110 and the scanning part is referred to as a scanner 120.

As illustrated in FIG. 1, the printer 110 includes four process units 1C, 1M, 1Y, and 1K, each of which functions as an image forming device. The process units 1C, 1M, 1Y, and 1K form cyan C, magenta (M), yellow (Y), and black (K) images, respectively. The four process units 1C, 1M, 1Y, and 1K have identical configurations, except for toner colors. In the following description, for convenience, C (cyan), M (magenta), Y (yellow), and K (black) are added as suffixes corresponding to the toner colors of the image to be formed after reference numerals indicating respective units and members. In particular, in the general description, these suffixes are appropriately omitted and the respective units and parts are described collectively in a singular form.

The process unit 1 (i.e., the process units 1C, 1M, 1Y, and 1K) includes a drum-shaped image bearer 2 (i.e., drum-shaped image bearers 2C, 2M, 2Y, and 2K). The four image bearers 2C, 2M, 2Y, and 2K are aligned along the horizontal direction (in other words, the left and right directions) at equally spaced intervals in the printer 110. When a driving force that is generated by a drive source is transmitted to the image bearers 2C, 2M, 2Y, and 2K at the start of the image forming apparatus 100, the image bearers 2C, 2M, 2Y, and 2K rotate in a clockwise direction of FIG. 1. A toner image is formed on the image bearer 2 (i.e., the image bearers 2C, 2M, 2Y, and 2K) according to the image forming processes using laser beams in the process unit 1 (i.e., the process units 1C, 1M, 1Y, and 1K).

A transfer device 15 is disposed below the image bearer 2 (i.e., the image bearers 2C, 2M, 2Y, and 2K). The transfer device 15 includes an intermediate transfer belt 16 of a shape of an endless loop. One end of the intermediate transfer belt 16 is wound around a driven roller 17 and an opposed end of the intermediate transfer belt 16 is wound around a drive roller 18. As the drive roller 18 that is driven by the drive source rotates, the intermediate transfer belt 16 moves in a direction indicated by arrow. While the intermediate transfer belt 16 is rotating, the surface of the image bearer 2 contacts an upper face of the outer circumference of the intermediate transfer belt 16. Four primary transfer rollers 19C, 19M, 19Y, and 19K are disposed facing the image bearers 2C, 2M, 2Y, and 2K, respectively, in the inner circumference (that is, the loop) of the intermediate transfer belt 16.

A belt cleaning device 21 is disposed near the right end portion on the outer circumference of the intermediate transfer belt 16. The belt cleaning device 21 removes residual toner and foreign matters such as paper powder from the outer face of the intermediate transfer belt 16.

A secondary transfer roller 20 is disposed on the outer circumference of the intermediate transfer belt 16, at a position opposite the drive roller 18 via the intermediate transfer belt 16. The secondary transfer roller 20 contacts the intermediate transfer belt 16 at the position opposite (in other word, facing) the drive roller 18, forming an area of contact, hereinafter referred to as a secondary transfer nip region, between the secondary transfer roller 20 and the intermediate transfer belt 16. In the secondary transfer nip region, a bias is applied while a sheet P that functions as a recording medium is passing between the intermediate transfer belt 16 and the secondary transfer roller 20, so that a toner image I that is borne on the surface of the intermediate transfer belt 16 is electrically transferred onto a sheet P.

Further, the printer 110 is provided with a sheet guiding device 74 to guide the sheet P. The sheet guiding device 74 includes a sheet tray 30 that functions as a sheet container, a sheet feeding device 47 that feeds the sheet P loaded on the sheet tray 30, and a cover unit 130. A bottom plate 46 is disposed in the sheet tray 30, so that a plurality of sheets P is loaded in layers on the bottom plate 46 of the sheet tray 30. In FIG. 1, the left end side of the bottom plate 46 is rotatably supported by a support shaft and the right end side of the bottom plate 46 is movable in the vertical direction. The bottom plate 46 is constantly biased upward by the force of a spring.

The sheet feeding device 47 is disposed on the upper part of the front side of the sheet tray 30 and feeds an uppermost sheet P of a sheet bundle loaded on the sheet tray 30. The sheet feeding device 47 includes a pickup roller 47*a*, a reverse roller 47*b*, and a feed roller 47*c*. The pickup roller 47*a* comes into contact with the uppermost sheet P of the sheet bundle loaded on the sheet tray 30 and feeds the uppermost sheet P from the sheet tray 30. The reverse roller 47*b* is coupled to the drive source via a torque limiter and contacts the feed roller 47*c* to form a sheet separation nip region. The reverse roller 47*b* is rotationally driven by a drive source in a direction to return the excessive sheet(s) to the sheet tray 30 (in other words, the counterclockwise direction in FIG. 1).

When a single sheet is held in the sheet separation nip region or when no sheet is held in the sheet separation nip region, rotation driving force of the feed roller 47*c* drives the reverse roller 47*b*, making the load torque greater than the slip torque of the torque limiter. Therefore, at this time, the reverse roller 47*b* is rotated along with the feed roller 47*c* to be moved (activated) in a direction to feed the sheet P (that is, the clockwise direction in FIG. 1).

On the other hand, when a plurality of sheets are held in the sheet separation nip region, the load torque applied to the reverse roller 47*b* is reduced to be smaller than the slip torque of the torque limiter due to the slippage of the sheets of the plurality of sheets. As a result, the driving force of the drive source is transmitted to the reverse roller 47*b* via the torque limiter, so that the reverse roller 47*b* is rotationally driven in a reverse direction that is opposite to the rotational direction of the feed roller 47*c*. Accordingly, when the plurality of sheets P is nipped in the sheet separation nip region, the second and subsequent sheets P except the uppermost sheet P are conveyed in the direction to return the excessive sheet(s), in other words, the second and subsequent sheets P to the sheet tray 30 by rotation of the reverse roller 47*b*. Accordingly, the second and subsequent sheets P of the plurality of sheets P are returned to the sheet tray 30.

A pair of sheet conveyance rollers 39 is disposed downstream from the sheet separation nip region in a sheet conveyance direction. A registration sensor 31 is disposed downstream from the pair of sheet conveyance rollers 39 in the sheet conveyance direction. A pair of registration rollers 32 is disposed further downstream from the registration sensor 31 in the sheet conveyance direction. The pair of registration rollers 32 is disposed immediately upstream from the intermediate transfer belt 16 in the sheet conveyance direction. In order to properly meet the toner image I on the surface of the intermediate transfer belt 16 with the position of the leading end of the sheet P, the pair of registration rollers 32 pauses the sheet P to bend (technically, warp) the sheet P temporarily. Immediately before the toner image I on the surface of the intermediate transfer belt 16 is transferred to the sheet P at the secondary transfer nip region, the sheet P that has temporarily been stopped at the pair of registration rollers 32 is fed out to the secondary transfer nip region at a given timing.

A fixing device 34 is disposed above the secondary transfer nip region between the secondary transfer roller 20 and the drive roller 18 via the intermediate transfer belt 16. The fixing device 34 includes a fixing roller 34*a* and a pressure roller 34*b*. The fixing roller 34*a* includes a heat source such as a halogen lamp. The pressure roller 34*b* rotates while contacting the fixing roller 34*a* with a given pressure. Note that the image forming apparatus 100 is not limited to employ the fixing device 34 described above. For example, the image forming apparatus 100 may employ a fixing device having an endless rotary belt or another configuration such as an induction heating (IH) system.

A sheet reentry portion 37 is provided on the right side of the printer 110 in FIG. 1. The sheet P that is switched back by a pair of sheet ejection rollers 35 is conveyed to the sheet reentry portion 37. In the sheet reentry portion 37, the sheet P is reversed so that the back face of the sheet P contacts the intermediate transfer belt 16, and then the sheet P is conveyed to the pair of registration rollers 32 again.

Further, a bypass tray 36 is provided on the right side of the printer 110 in FIG. 1. The bypass tray 36 loads a sheet P or a plurality of sheets P to be fed to the printer 110. The bypass tray 36 is openably and closably attached to the housing (the printer 110) of the image forming apparatus 100. When a sheet P is fed manually from outside the printer 110, the bypass tray 36 is opened to load the sheet P. The sheet P loaded on the bypass tray 36 is fed by a bypass sheet feed roller 36*a* to be conveyed in a bypass sheet conveyance passage 38 to the pair of registration rollers 32.

Next, a description is given of the basic operations of the printer 110.

In FIG. 1, in response to a sheet conveyance signal issued by a controller, the uppermost sheet P placed on top of the plurality of sheets P loaded on the bottom plate 46 of the sheet tray 30 is separated from the second and subsequent sheets P and conveyed toward the pair of registration rollers 32. When the bypass tray 36 is selected, the bypass sheet feed roller 36*a* rotates in response to the sheet conveyance signal issued by the controller, so that the uppermost sheet P on the bypass tray 36 is separated from the second and subsequent sheets P of the plurality of sheets P and conveyed toward the pair of registration rollers 32.

The timing at which the registration sensor 31 detects the leading end of the uppermost sheet P (hereinafter, the sheet P for convenience) triggers conveyance of the sheet P to the pair of registration rollers 32 until the sheet P is warped (bent) by a given amount in a registration nip region of the pair of registration rollers 32, so that skew at the leading end of the sheet P is corrected.

Next, a description is given of the image forming operation performed by the printer 110.

A visible image formed on the image bearer 2K is transferred onto the surface of the intermediate transfer belt 16 that moves in synchrony with movement of the image bearer 2K as primary transfer, by a transfer operation by the primary transfer roller 19K that is charged to the positive polarity. Such operations of latent image formation, development, and primary transfer are sequentially performed at respective timings corresponding to image data in each process unit 1 (i.e., the process units 1C, 1M, 1Y, and 1K). The cyan, magenta, yellow, and black toner images are sequentially overlaid onto the surface of the intermediate transfer belt 16 to form a four-color toner image I. Accordingly, the four-color toner image I is conveyed together with the intermediate transfer belt 16, the surface of which moves in a direction indicated by arrow in FIG. 1.

After the respective color toner images have been sequentially transferred in layers onto the surface of the intermediate transfer belt 16 to form the four-color toner image, the pair of registration rollers 32 starts rotating, so that the sheet P is conveyed to the secondary transfer roller 20 (the secondary transfer nip region) at the same timing as (in synchrony with) movement of the four-color toner image transferred and overlaid onto the surface of the intermediate transfer belt 16. The secondary transfer roller 20 is positively charged, and the toner image formed on the surface of the intermediate transfer belt 16 is transferred onto the sheet P that is conveyed from the pair of registration rollers 32, in the secondary transfer nip region of the secondary transfer roller 20. The transfer residual toner and foreign materials remaining on the surface of the intermediate transfer belt 16 are removed from the surface of the intermediate transfer belt 16 by a belt cleaning device 21, so as to make the intermediate transfer belt 16 ready for subsequent image formation and transfer processes.

The sheet P on which the transferred toner image is formed is conveyed to the fixing device 34. Thereafter, the sheet P that is conveyed to the fixing device 34 is held between the fixing roller 34*a* and the pressure roller 34*b*. Thus, the unfixed toner image on the sheet P is fixed to the sheet P by application of heat and pressure.

After the toner image is fixed to the sheet P in the fixing device 34, the sheet P is conveyed to the pair of sheet ejection rollers 35 to be ejected to the outside of the printer 110. A sheet stacker 110*a* is provided on a top face of the printer 110. The sheet P ejected to the outside of the printer 110 by the pair of sheet ejection rollers 35 is stacked on the sheet stacker 110*a*.

In a duplex printing mode by which images are formed on both sides of the sheet P, after the sheet P having the toner image on the first (front) side alone has passed through the fixing device 34, the pair of sheet ejection rollers 35 switches back the sheet P to feed the sheet P to the sheet reentry portion 37, so that the sheet P passes through the sheet reentry portion 37 to be conveyed to the pair of registration rollers 32 again. After the sheet P is conveyed from the registration nip region to the secondary transfer nip region and the toner image is formed on the second (back) side of the sheet P, the fixing device 34 fixes the toner image formed on the second side to the sheet P. Then, the sheet P having images on both sides is conveyed to the pair of sheet ejection rollers 35 and is stacked on the sheet stacker 110*a*.

Figure 2:
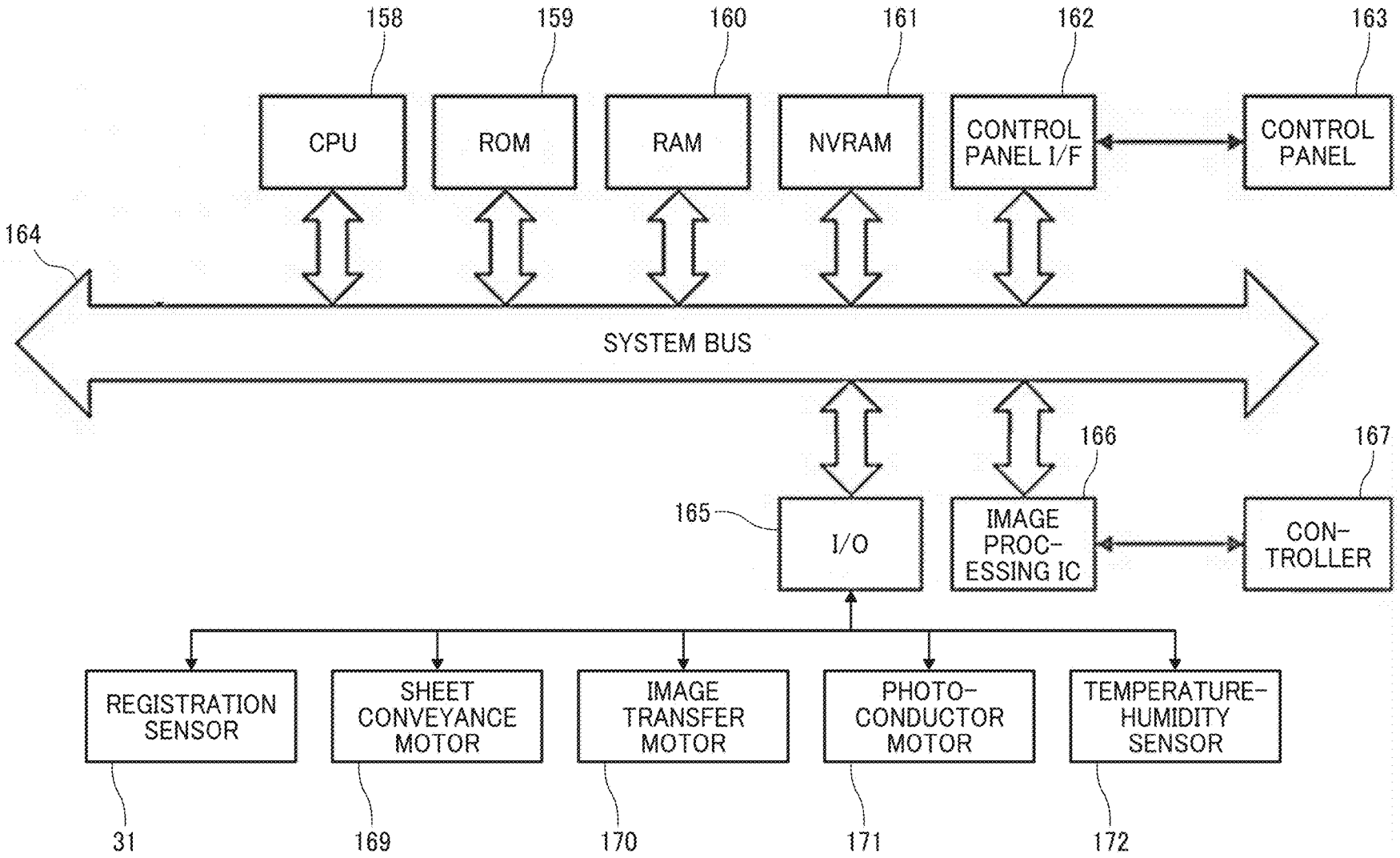
FIG. 2 is a hardware block diagram of the image forming apparatus.

FIG. 2 is a hardware block diagram of the image forming apparatus 100.

A central processing unit (CPU) 158 is a CPU of the image forming apparatus 100 and controls overall accesses with various devices connected to a system bus 164 based on control programs stored in a read only memory (ROM) 159 (simply referred to as the ROM 159. The CPU 158 also controls inputs and outputs of devices such as sensors, motors, clutches, and high voltage power supplies, which are connected to the CPU 158 via an input and output (I/O) unit 165 (simply referred to as the I/O 165). That is, the CPU 158 executes the control programs of the image forming apparatus 100, which are stored in the ROM 159.

A random access memory (RAM) 160 functions as a main memory and work area of the CPU 158 to be used as, for example, a recording data operating region and an environment data storing region. A non-volatile random access memory 161 (simply referred to as the NVRAM 161) stores information regarding the image forming apparatus 100, used by the control program.

Figure 3:
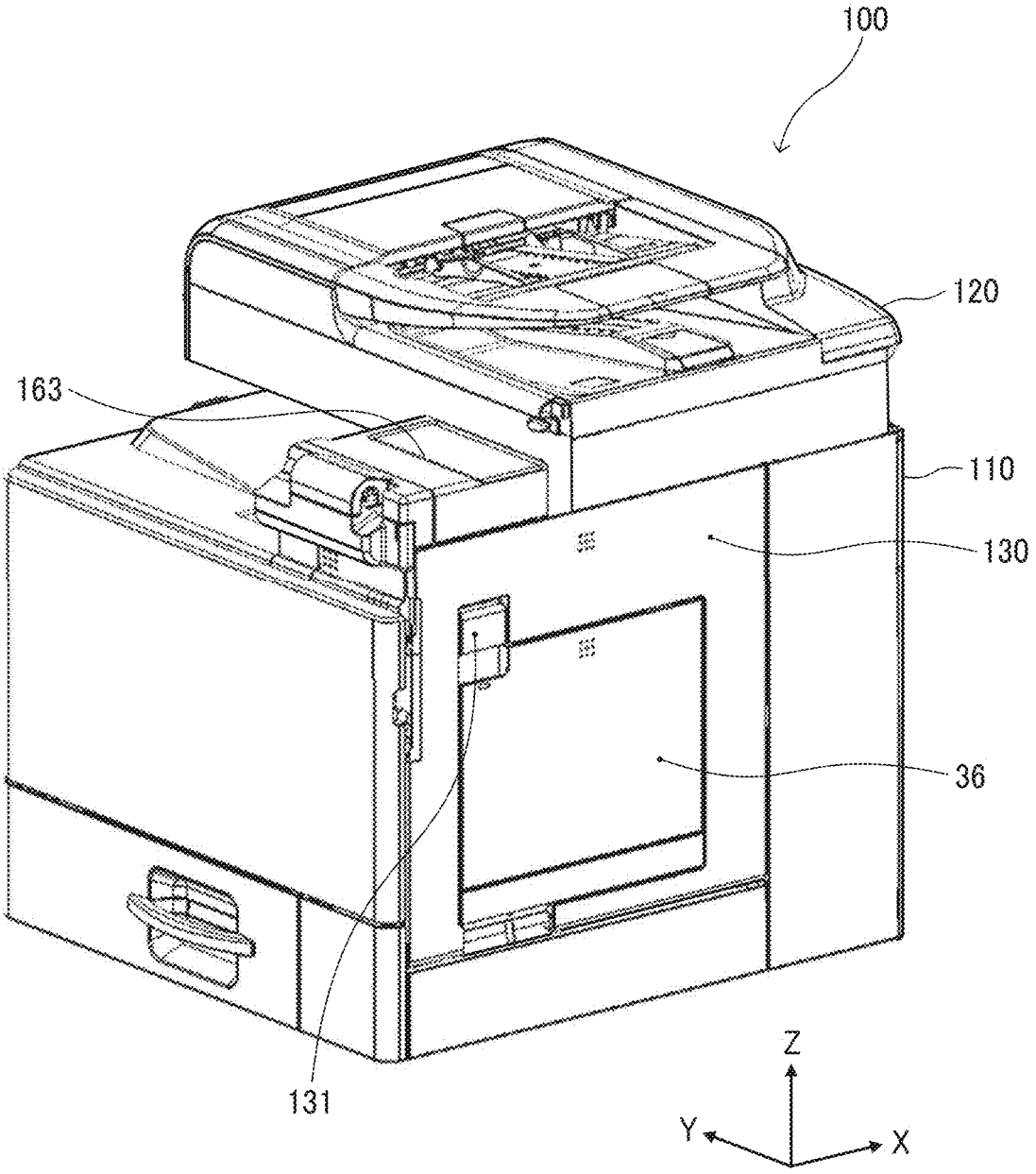
FIG. 3 is a perspective view illustrating the image forming apparatus, viewed from the right side.

A user selects and sets operation modes such as a printing mode via a control panel 163 that is connected via a control panel I/F 162 (see FIG. 3). The registration sensor 31 is a sensor to detect whether a sheet is being conveyed. A sheet conveyance motor 169 drives the pair of registration rollers 32, for example, to convey the sheet P. An image transfer motor 170 drives the drive roller 18 (the intermediate transfer belt 16). A photoconductor motor 171 drives the image bearers 2C, 2M, 2Y, and 2K. A temperature-humidity sensor 172 measures temperature and humidity in the image forming apparatus 100. A controller 167 is connected to an image processing integrated circuit (IC) 166 to acquire printing conditions such as the thickness of a sheet on which an image is to be printed. The image processing IC 166 performs given processing on image data acquired by the scanner 120 or image data sent from an external device such as a personal computer.

FIG. 3 is a perspective view illustrating the image forming apparatus 100, viewed from the right side.

Note that, in the following description, a Z direction represents the upward-and-downward direction (in other words, the vertical direction), an X direction represents the front-and-back direction (in other words, the axial direction) of the image forming apparatus 100, and a Y direction represents the left-and-right direction (in other words, the horizontal direction) of the image forming apparatus 100.

As illustrated in FIG. 3, the image forming apparatus 100 includes a cover unit 130 on the right side face (in other words, the −Y direction side face). The cover unit 130 is openable and closable to the printer 110. The cover unit 130 includes a handle 131. Moving the handle 131 rotates a hook 132 (see FIG. 6) to unlock the locking of the cover unit 130 to the printer 110. By pulling the handle 131 in the −Y direction with the locking of the cover unit 130 being unlocked, the cover unit 130 is rotated about the lower end as a fulcrum.

Figure 4:
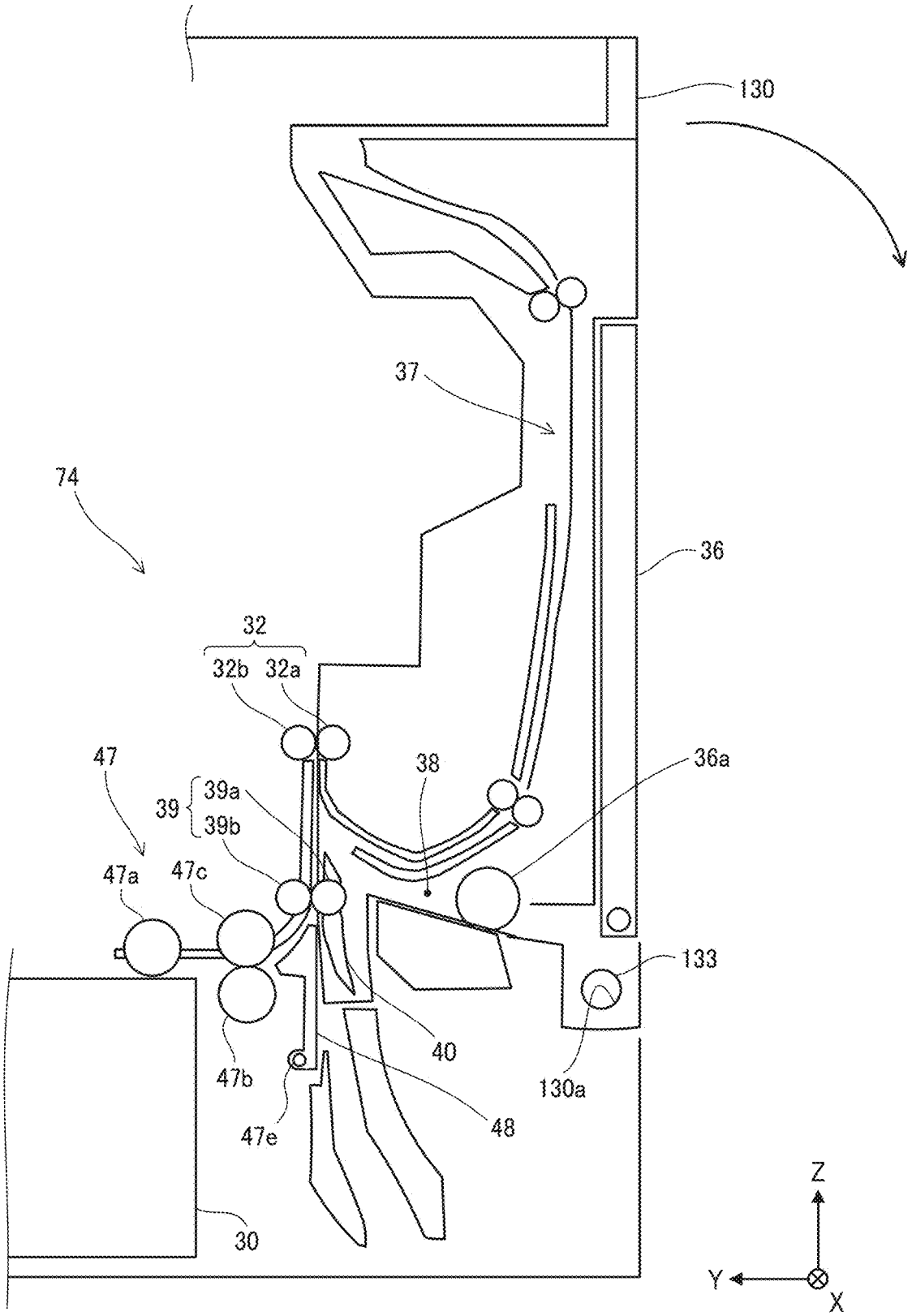
FIG. 4 is a diagram illustrating a schematic configuration of a cover unit included in the image forming apparatus.

FIG. 4 is a diagram illustrating a schematic configuration of a sheet guiding device 74 including the cover unit 130 of the image forming apparatus 100.

The sheet guiding device 74 includes the sheet tray 30 that functions as a sheet container, the sheet feeding device 47 to feed a sheet of a sheet bundle loaded on the sheet tray 30, the pair of sheet conveyance rollers 39, the pair of registration rollers 32, and a swing guide 48. The sheet guiding device 74 further includes the cover unit 130 that is provided with the sheet reentry portion 37, the bypass tray 36, the bypass sheet conveyance passage 38, and the bypass sheet feed roller 36*a*. Further, the cover unit 130 includes a sheet conveyance drive roller 39*a* of the pair of sheet conveyance rollers 39 and a registration driven roller 32*a* of the pair of registration rollers 32. The registration driven roller 32*a* is disposed facing a registration drive roller 32*b* of the pair of registration rollers 32. Furthermore, the cover unit 130 is provided with a sheet conveyance drive motor 69 (see FIG. 5) and a guide member 40. The sheet conveyance drive motor 69 drives the sheet conveyance drive roller 39*a*. The guide member 40 guides a sheet fed from an optional sheet tray that may be disposed below the printer 110. The guide member 40 provided in the cover unit 130 is disposed facing the swing guide 48 in a state in which the cover unit 130 is closed to the printer 110.

The cover unit 130 is openable and closable to the sheet guiding device 74. By rotating about a support shaft 133 as a fulcrum in the clockwise direction of FIG. 4, the upper part of the cover unit 130 is released to open the cover unit 130. As the cover unit 130 opens, the sheet reentry portion 37 of the sheet guiding device 74, the sheet conveyance passage form the pair of sheet conveyance rollers 39 to the pair of registration rollers 32, and the sheet ejection passage from the fixing device 34 to the pair of sheet ejection rollers 35, so that a sheet jammed in any of these sheet conveyance passages of the sheet guiding device 74 is removed easily.

Figure 5:
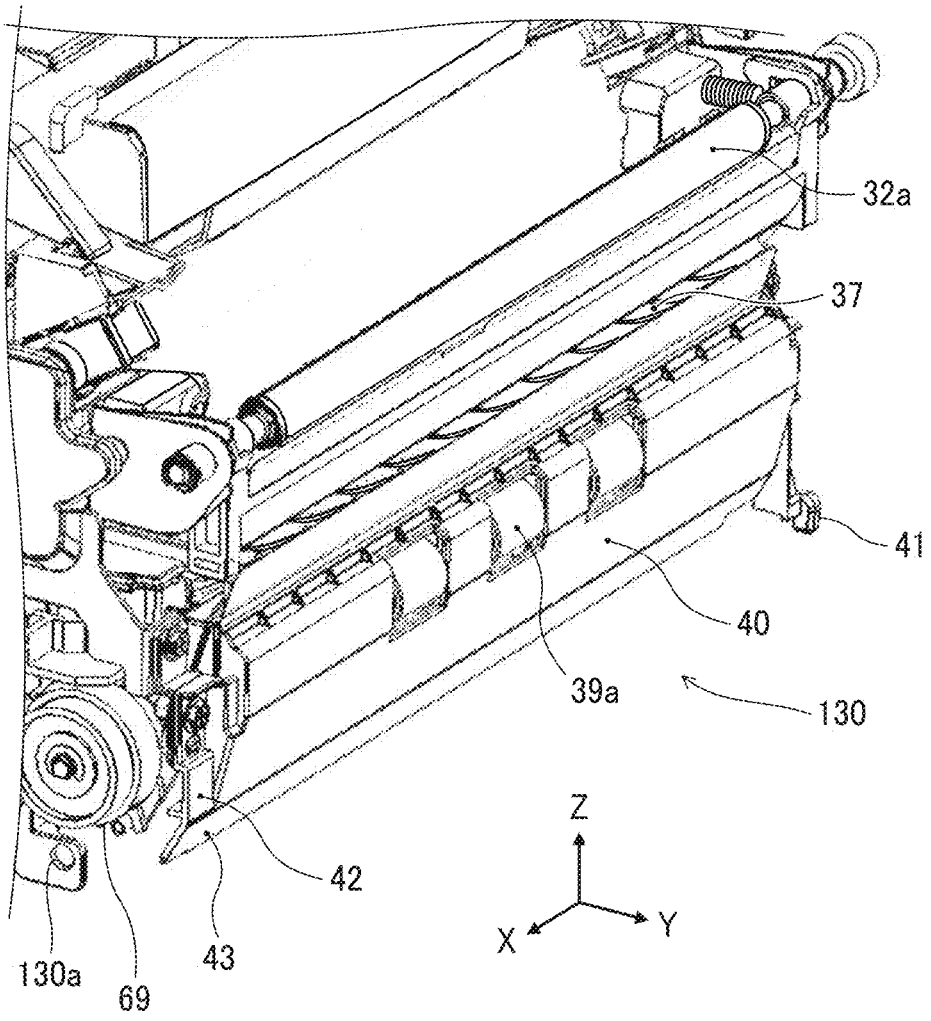
FIG. 5 is a diagram illustrating a schematic configuration of the cover unit, viewed from the rear side of the image forming apparatus.
Figure 6:
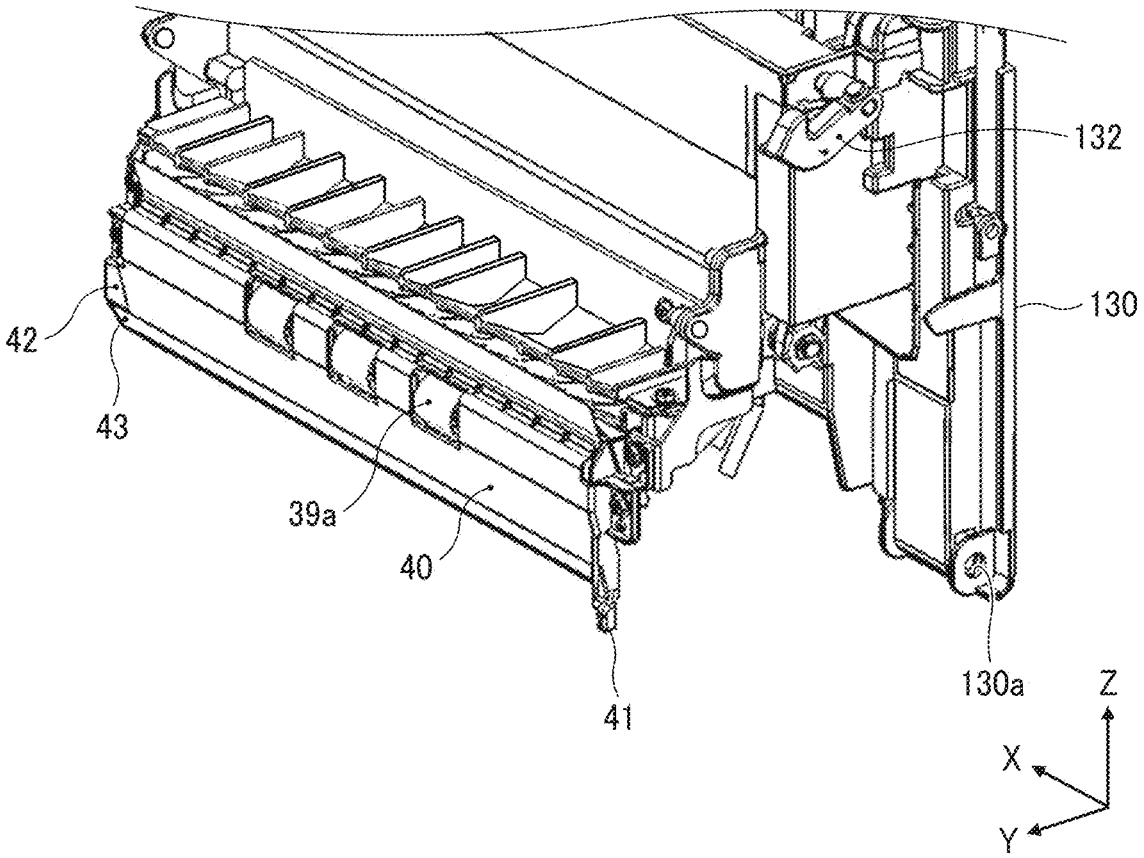
FIG. 6 is a diagram illustrating a schematic configuration of the cover unit, viewed from the front side of the image forming apparatus.

FIG. 5 is a diagram illustrating a schematic configuration of the cover unit 130, viewed from the rear side (i.e., a +X direction) of the image forming apparatus 100. FIG. 6 is a diagram illustrating a schematic configuration of the cover unit 130, viewed from the front side (i.e., the −X direction) of the image forming apparatus 100.

Support holes 130*a* are provided at both lower ends of the cover unit 130 in the X direction of the cover unit 130. As illustrated in FIG. 4, a support shaft 133 provided in the housing (the printer 110) of the image forming apparatus 100 is inserted through the support holes 130*a*. By so doing, the cover unit 130 is rotatably supported by the support shaft 133 as a fulcrum to rotate in a direction indicated by arrow in FIG. 4.

Figure 7:
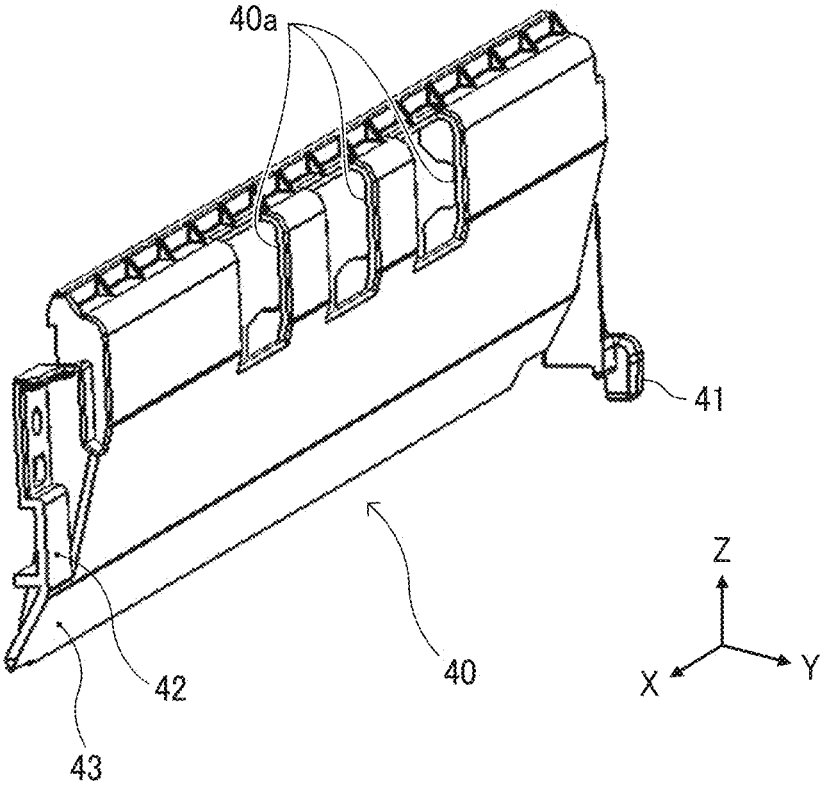
FIG. 7 is a perspective view illustrating a guide member included in the cover unit.

FIG. 7 is a perspective view illustrating the guide member 40 included in the cover unit 130.

As illustrated in FIG. 7, the guide member 40 includes a pressing member 41 at an end portion of the front side (in other words, an end portion in the −X direction). The pressing member 41 functions as a contact member to contact a link member 50 (see FIG. 8) that is described below. The guide member 40 further includes a pressing portion 42 and a slant portion 43. The pressing portion 42 is disposed at an end portion of the rear side (in other words, an end portion in the +X direction) to press a second biasing mechanism 70 (see FIG. 8) that biases the swing guide 48 toward the guide position. The slant portion 43 is coupled to the lower end of the pressing portion 42 and slants toward the cover unit 130 downwardly. Further, holes 40*a* are formed in the upper part of the guide member 40 so that parts of the roller portion of the sheet conveyance drive roller 39*a* are projected form the holes 40*a*.

Figure 8:
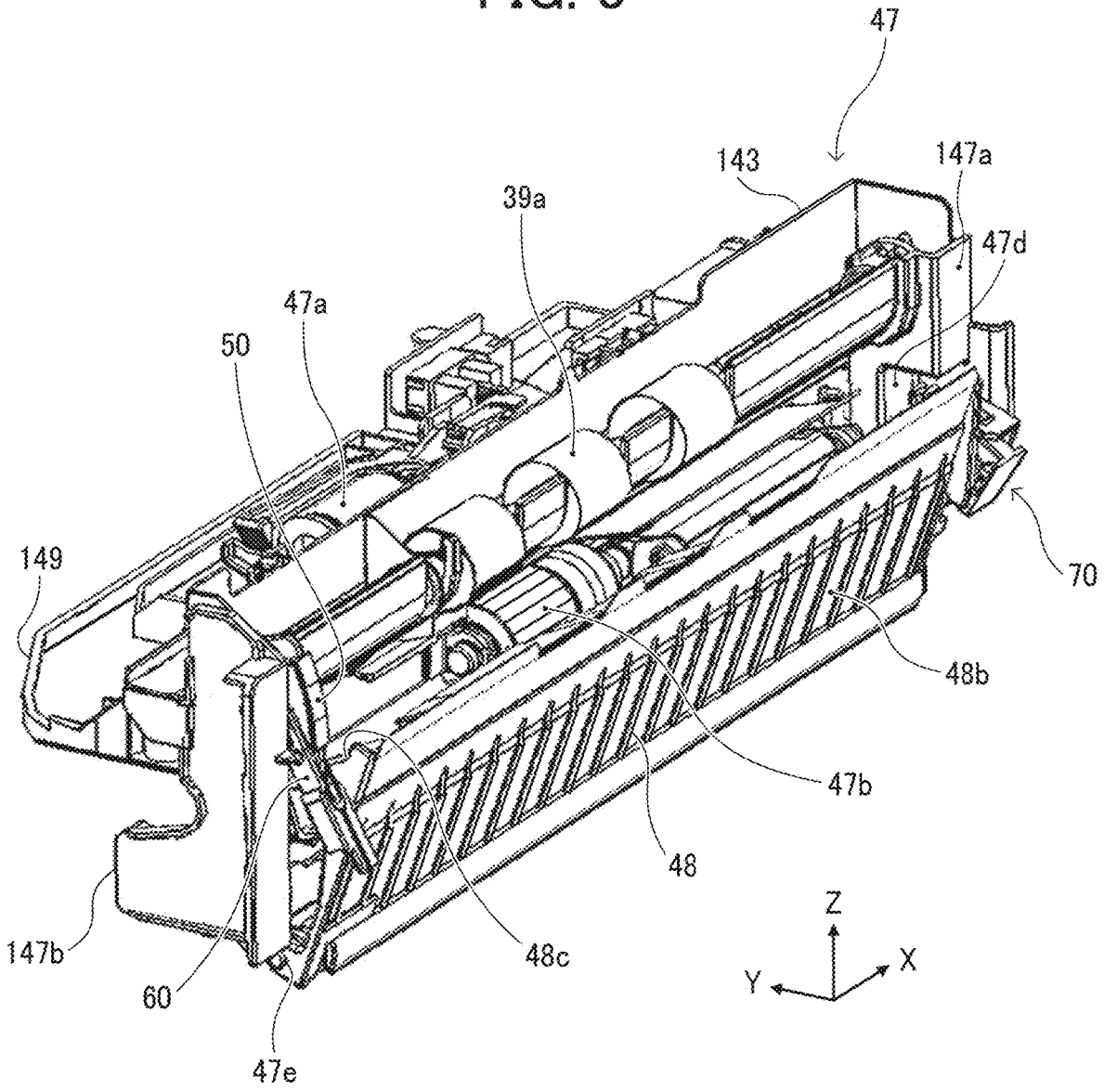
FIG. 8 is a perspective view illustrating a sheet feeding device with a swing guide open.
Figure 9:
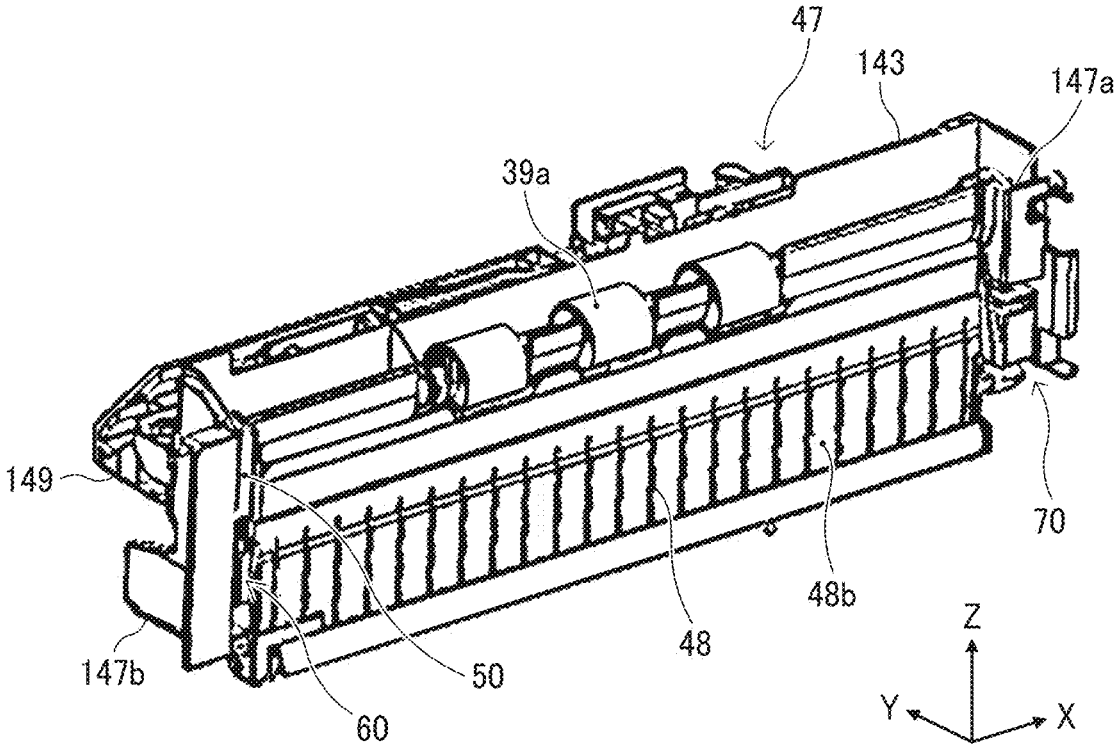
FIG. 9 is a perspective view illustrating the sheet feeding device with the swing guide closed.
Figure 10:
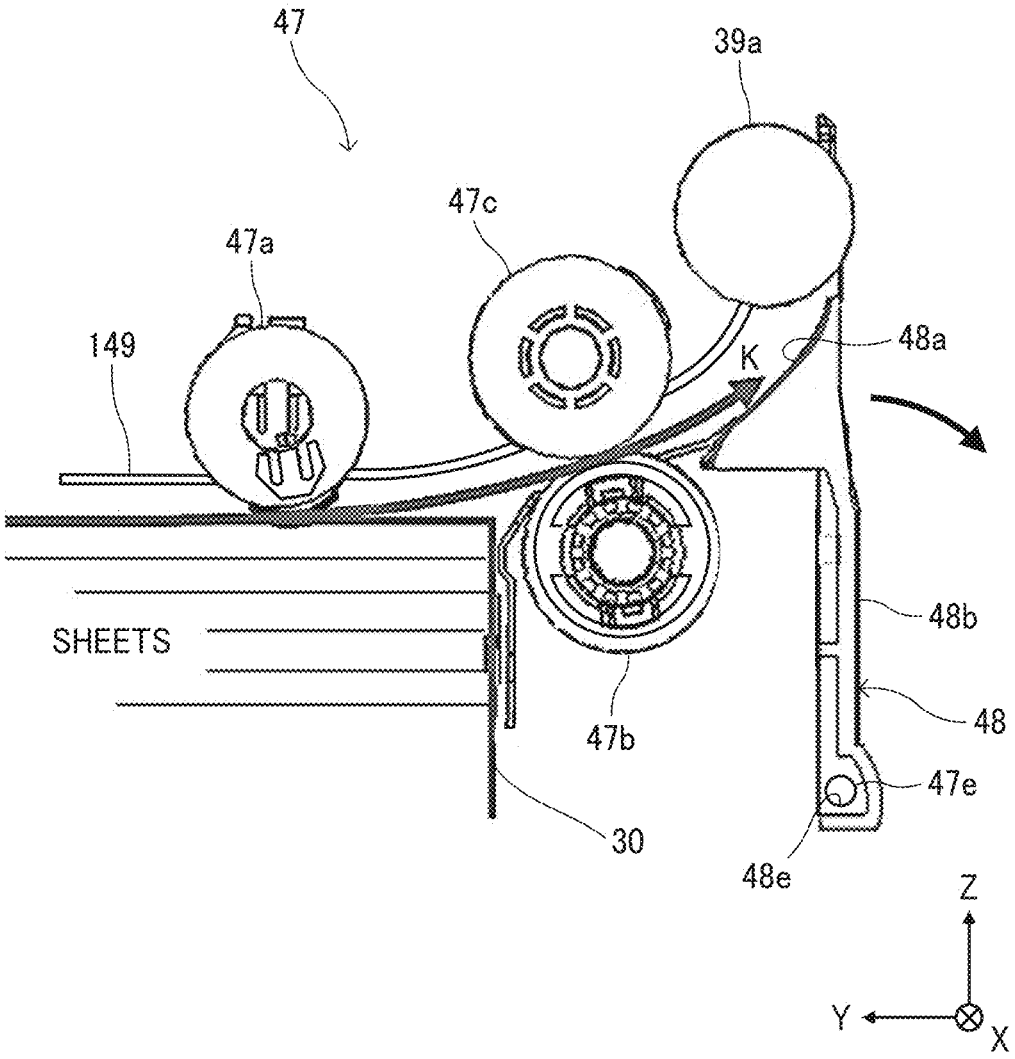
FIG. 10 is a schematic cross-sectional view illustrating the sheet feeding device.
Figure 11:
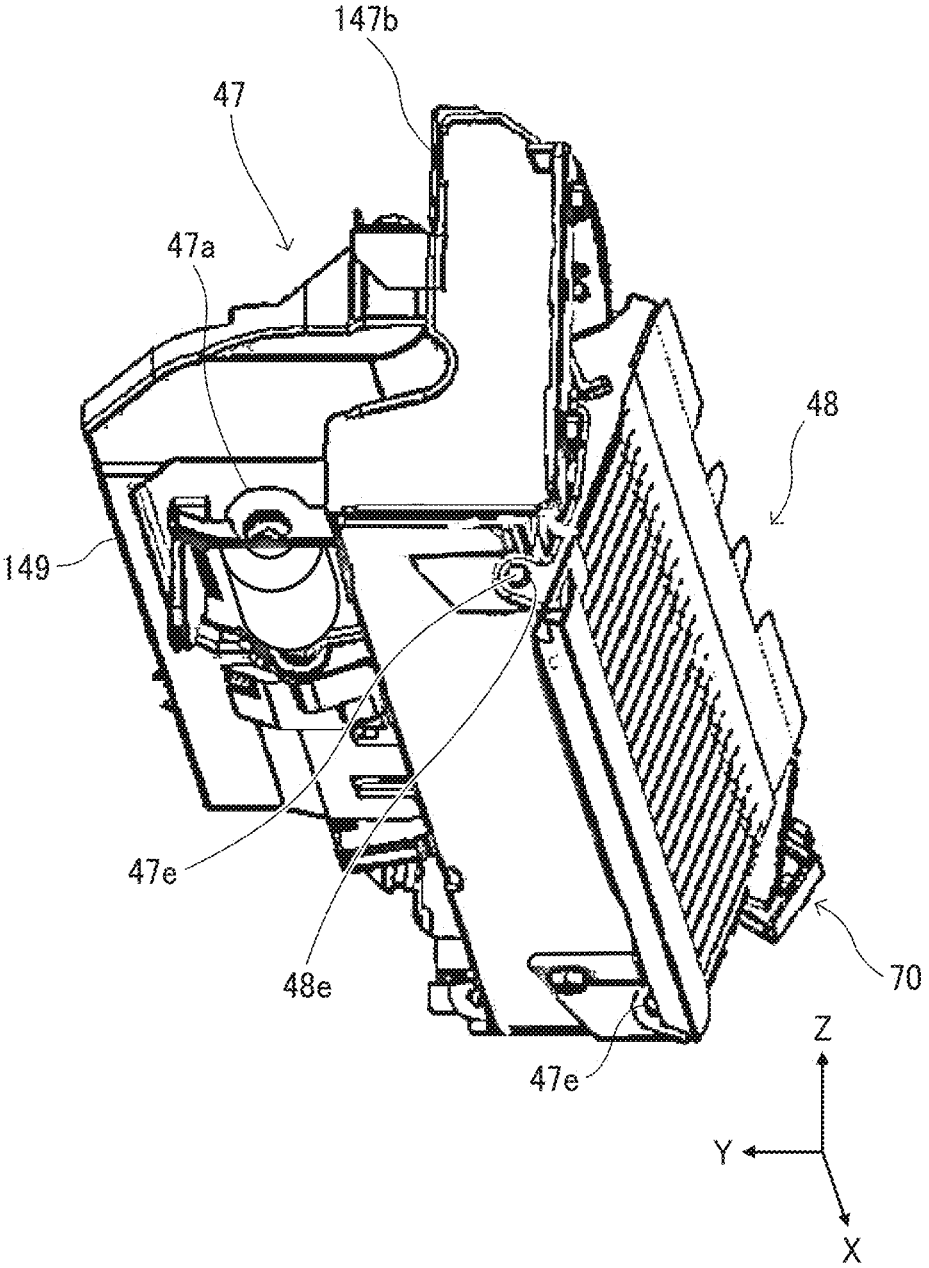
FIG. 11 is a perspective view illustrating the sheet feeding device, viewed from below.
Figure 12:
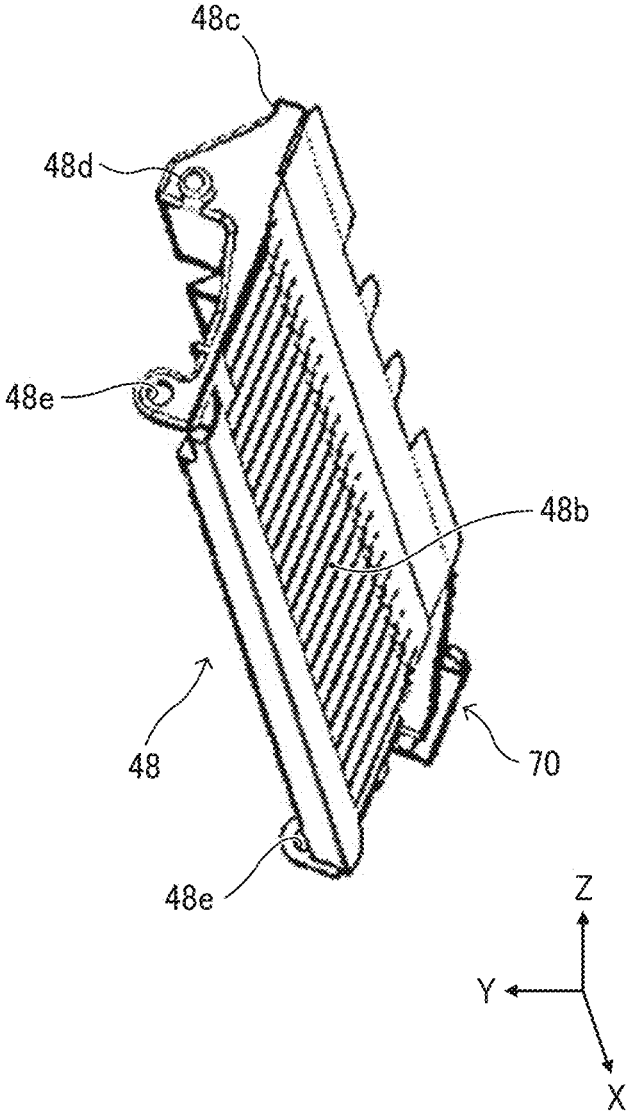
FIG. 12 is a perspective view illustrating the swing guide.

FIG. 8 is a perspective view illustrating the sheet feeding device 47 with the swing guide 48 open. FIG. 9 is a perspective view illustrating the sheet feeding device 47 with the swing guide 48 closed. FIG. 10 is a schematic cross-sectional view illustrating the sheet feeding device 47. FIG. 11 is a perspective view illustrating the sheet feeding device 47, viewed from below. FIG. 12 is a perspective view illustrating the swing guide 48.

The sheet feeding device 47 includes the pickup roller 47*a*, the reverse roller 47*b*, the feed roller 47*c*, and a sheet feed guide 149 (see FIG. 10). The sheet feeding device 47 further includes a sheet conveyance driven roller 39*b* of the pair of sheet conveyance rollers 39 and the swing guide 48 (see FIG. 10). The swing guide 48 is swingable between the guide position (FIGS. 9 and 10) and a retracted position (FIGS. 8 and 11). At the guide position, the swing guide 48 is in a closed state in which the swing guide 48 guides the sheet P that has passed through a sheet separation nip region formed by contacting the reverse roller 47*b* to the feed roller 47*c*. At the retracted position, the swing guide 48 is in an open state in which the swing guide 48 is retracted from the guide position.

A known sheet guiding device includes a cover unit openably attached to a housing of an image forming apparatus and a swing guide to swing between a guide position at which the swing guide guides a sheet and a retracted position at which the swing guide is retracted from the guide position. The known sheet guiding device swings the swing guide from the retracted position to the guide position along with movement of the cover unit to close the cover unit. In the known sheet guiding device, the cover unit includes a cover side guide disposed facing the swing guide. The cover side guide has a projection to contact the swing guide. As a user closes the cover unit, the projection of the cover side guide contacts the swing guide at the retracted position, so that the swing guide is moved from the retracted position to the guide position along with the closing movement of the cover unit.

However, depending on the configuration of the cover unit, it is not likely that the swing guide at the retracted position swing to the guide position smoothly along with the closing movement of the cover unit.

Further, as illustrated in FIG. 8, the sheet feeding device 47 includes the link member 50 on the front side (in the −X direction) of the sheet feeding device 47. The link member 50 swings (hereinafter, rotates) the swing guide 48 at the retracted position to the guide position, along with a closing movement of the cover unit 130 illustrated in FIG. 4. The sheet feeding device 47 further includes a first biasing mechanism 60 on the front side (in the −X direction) of the sheet feeding device 47. The first biasing mechanism 60 functions as a biasing member to bias the swing guide 48 at the guide position to the guide position. Further, the second biasing mechanism 70 is provided at the end portion on the rear side (in the +X direction) of the swing guide 48. The second biasing mechanism 70 functions as a biasing member to bias the swing guide 48 at the guide position to the guide position.

Further, as illustrated in FIG. 8, the sheet feeding device 47 includes the link member 50 on the front side (in the −X direction) of the sheet feeding device 47. The link member 50 rotates the swing guide 48 at the retracted position to the guide position, along with a closing movement of the cover unit 130 illustrated in FIG. 4. The sheet feeding device 47 further includes a first biasing mechanism 60 on the front side (in the −X direction) of the sheet feeding device 47. The first biasing mechanism 60 functions as a biasing member to bias the swing guide 48 at the guide position to the guide position. Further, the second biasing mechanism 70 is provided at the end portion on the rear side (in the +X direction) of the swing guide 48. The second biasing mechanism 70 functions as a biasing member to bias the swing guide 48 at the guide position to the guide position.

In the present embodiment, the link member 50 is disposed on the front side of the sheet feeding device 47 but is not disposed on the rear side of the sheet feeding device 47 since there is no space for the link member 50 due to the layout of the sheet feeding device 47. However, if there is space, the link member 50 may be disposed on the rear side as well as on the front side, so that the link members 50 may disposed on both sides of the swing guide 48 in the X direction of the swing guide 48.

Note that the sheet feeding device 47 further includes a contact face 47*d* illustrated in FIG. 8, to which a second positioning portion 48*g* (see FIG. 19) provided at the end portion on the rear side of the swing guide 48 contacts.

As illustrated in FIG. 10, the swing guide 48 includes a sheet feed guide 48*a* and an option guide 48*b*. The sheet feed guide 48*a* is disposed tilted and facing the sheet feed guide 149 to guide a sheet that has passed through the sheet separation nip region. The option guide 48*b* is disposed facing the guide member 40 provided on the cover unit 130. The option guide 48*b* guides a sheet fed from the optional sheet tray disposed below the printer 110.

The sheet feed guide 48*a* guides a sheet fed in a substantially horizontal direction (in a −Y direction) to direct to a substantially vertical and upward direction (a +Z direction), so as to change the course of conveyance of the sheet from the substantially horizontal direction to the substantially vertical direction.

As illustrated in FIGS. 11 and 12, support holes 48*e* are provided at both ends of the lower end of the swing guide 48 in the X direction of the swing guide 48. Swing shafts 47*e* are provided at the lower end of respective side panels (that is, a rear side panel 147*a* and a front side panel 147*b*) fixed to a frame 143 (see FIG. 8) extending in the X direction of the sheet feeding device 47. The swing shaft 47*e* of the front side panel 147*b* is mounted on an outer face of the front side panel 147*b* and the swing shaft 47*e* of the rear side panel 147*a* is mounted on an inner face of the rear side panel 147*a*. As described above, by mounting one swing shaft 47*e* on the inner face of the side plate and another swing shaft 47*e* on the outer face of a different side plate, the swing guide 48 is moved from the front side to the rear side of the image forming apparatus 100 or from the rear side to the front side of the image forming apparatus 100 so that the swing shafts 47*e* are inserted into the support holes 48*e*, thereby attaching the swing guide 48 to the sheet feeding device 47.

Accordingly, by inserting the swing shafts 47*e* through the support holes 48*e*, the swing guide 48 is supported to rotate about each swing shaft 47*e* as a fulcrum, between the guide position illustrated in FIG. 9 and the retracted position illustrated in FIG. 8.

In the present embodiment, the swing guide 48 swings about the lower end as a fulcrum so that the upper portion of the swing guide 48 is released to open when the swing guide 48 is at the retracted position, as illustrated in FIGS. 8 and 11. As a result, the sheet jammed in the sheet separation nip region is reliably removed from the upper portion of the swing guide 48.

Further, as illustrated in FIG. 12, a link engaging projection 48*d* at the end portion on the front side of the swing guide 48 to engage with the opposite end of the link member 50 (see FIG. 8). Further, a first positioning portion 48*c* illustrated in FIG. 12 positions the front side of the swing guide 48.

Figure 13:
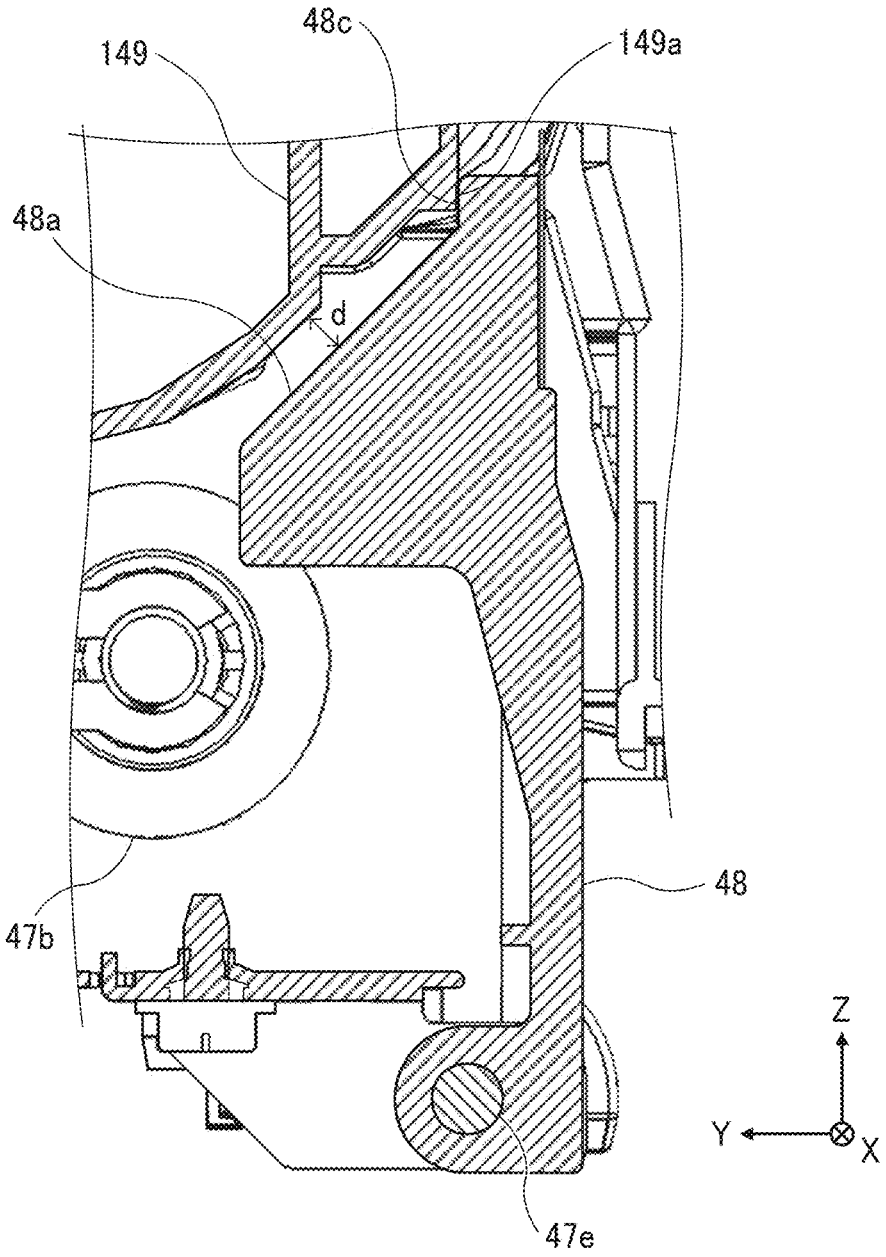
FIG. 13 is a diagram for explaining positioning of the front side of the swing guide.

FIG. 13 is a diagram for explaining positioning of the front side of the swing guide 48.

As illustrated in FIG. 13, when the front side of the swing guide 48 is biased to the guide position side by the first biasing mechanism 60 (see FIG. 9), the first positioning portion 48*c* contacts a contact face 149*a* provided on the end portion on the front side of the sheet feed guide 149 to position the front side of the swing guide 48. By so doing, a distance (gap) between the sheet feed guide 48*a* on the front side of the swing guide 48 and the sheet feed guide 149 on the front side of the swing guide 48 is set to a specified distance, and therefore the front side of the sheet that has passed through the sheet separation nip region is guided by the sheet feed guide 149 and the sheet feed guide 48*a* reliably.

Figure 14:
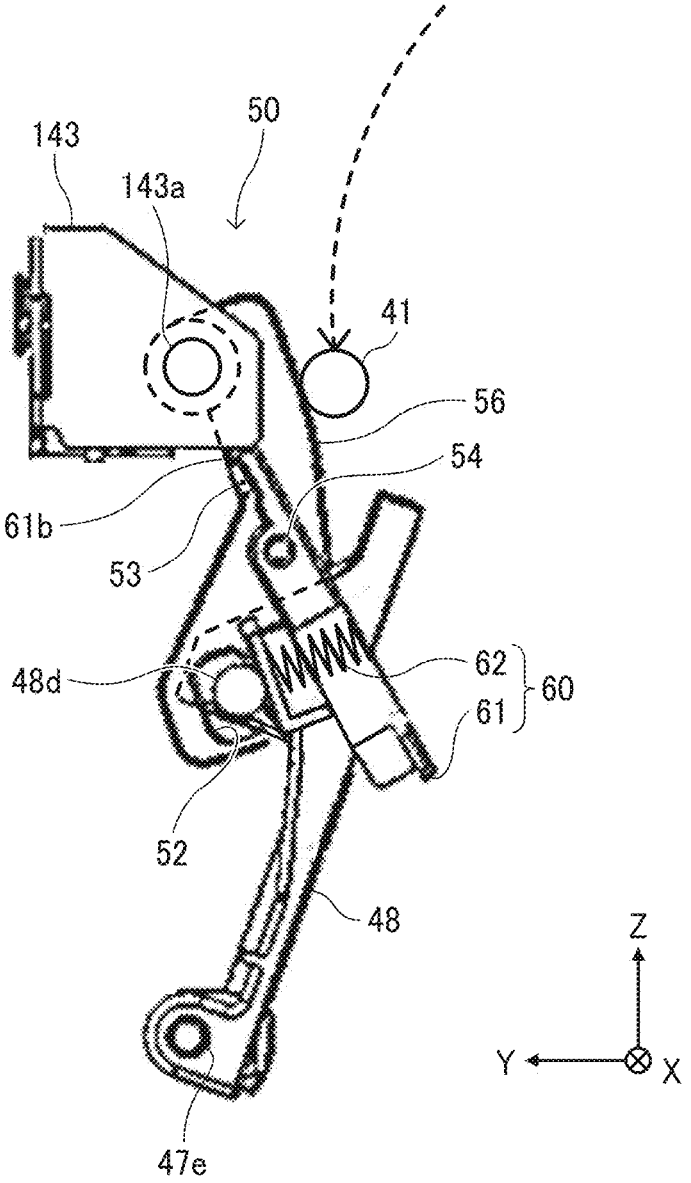
FIG. 14 is a diagram illustrating a schematic configuration of a link member, a first biasing mechanism, and the swing guide.
Figure 15:
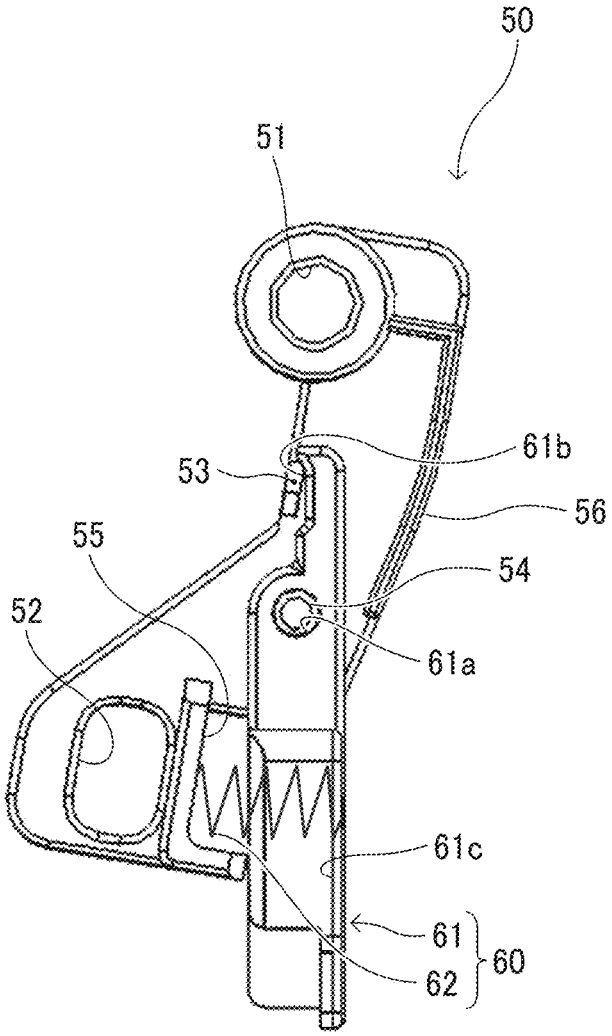
FIG. 15 is a diagram illustrating a schematic configuration of the link member and the first biasing mechanism.

FIG. 14 is a diagram illustrating a schematic configuration of the link member 50, the first biasing mechanism 60, and the swing guide 48. FIG. 15 is a diagram illustrating a schematic configuration of the link member 50 and the first biasing mechanism 60.

The first biasing mechanism 60 includes a first pressing portion 61 and a first compression spring 62. The first pressing portion 61 includes a support hole 61*a* and the link member 50 includes a support shaft 54. The support shaft 54 of the link member 50 is inserted through the support hole 61*a* of the first pressing portion 61. The first pressing portion 61 is rotatably supported by the link member 50 to rotate about the support shaft 54 as a fulcrum. The first compression spring 62 has one end that contacts a spring holder 61*c* of the first pressing portion 61 and an opposite end that contacts a spring holder 55 of the link member 50.

Further, the link member 50 includes a regulation projection 53 to regulate rotation of the first pressing portion 61 (in the counterclockwise direction in FIG. 14) by a biasing force of the first compression spring 62. The first pressing portion 61 further includes a contact portion 61*b*. As the contact portion 61*b* provided at the tip of the first pressing portion 61 contacts the regulation projection 53, rotation of the first pressing portion 61 is regulated by the biasing force of the first compression spring 62.

As illustrated in FIG. 15, a retaining hole 51 is provided at one end of the link member 50. The retaining hole 51 rotatably retains a link retaining shaft 143*a* (see FIG. 14) provided on the frame 143 of the sheet feeding device 47. Further, a guide engaging hole 52 having a long hole shape is provided at the opposite end of the link member 50. The link engaging projection 48*d* (see FIG. 14) of the swing guide 48 engages with the guide engaging hole 52. The spring holder 55 of the link member 50 is disposed adjacent to the guide engaging hole 52 on the right side (that is, the cover unit side) of the guide engaging hole 52 in FIG. 15 to hold the first compression spring 62. According to this configuration, the biasing force of the first compression spring 62 that is applied to the link engaging projection 48*d* (see FIG. 14) via the link member 50 is directed in a direction substantially parallel to a direction of the swing guide 48 to the guide position (in other words, the +Y direction). Therefore, the swing guide 48 is retained at the guide position reliably.

In the present embodiment, the opposite end of the first compression spring 62 is in contact with the link member 50 to bias the swing guide 48 via the link member 50. Alternatively, the opposite end of the first compression spring 62 may be in contact with the swing guide 48 to directly bias the swing guide 48.

A broken arrow in FIG. 14 indicates a trajectory of movement of the pressing member 41 when the cover unit 130 is closed. The pressing member 41 contacts a contact face 56 of the link member 50. The contact face 56 has a convex surface.

Even though the cover unit 130 (see FIG. 4) has a play in the front-and-back direction (in other words, in the X direction) or the cover unit 130 is twisted when the cover unit 130 is closed, the contact face 56 of the link member 50 has a certain width (a certain length in the X direction) so that part of the pressing member 41 contacts the contact face 56. Note that, even though the cover unit 130 (see FIG. 4) has such a play in the front-and-back direction (in other words, in the X direction) or the cover unit 130 is twisted when the cover unit 130 is closed, the width in the X direction of the pressing member 41 may be increased to cause the part of the pressing member 41 to contact the contact face 56.

Figure 16A:
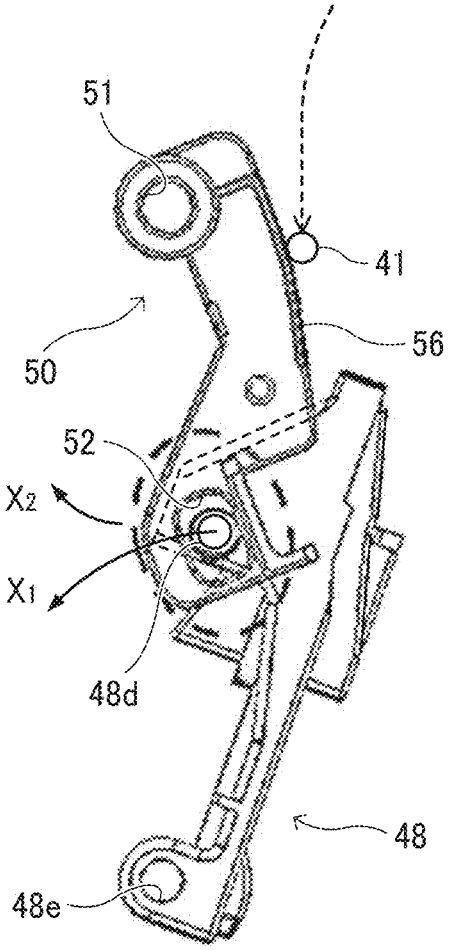

FIGS. 16A and 6B are diagrams illustrating a schematic configuration of the link member 50 and the swing guide 48. To be more specific, FIG. 16A illustrates a state in which the swing guide 48 is at the retracted position and FIG. 16B illustrates a state in which the swing guide 48 is at the guide position.

Figure 16B:
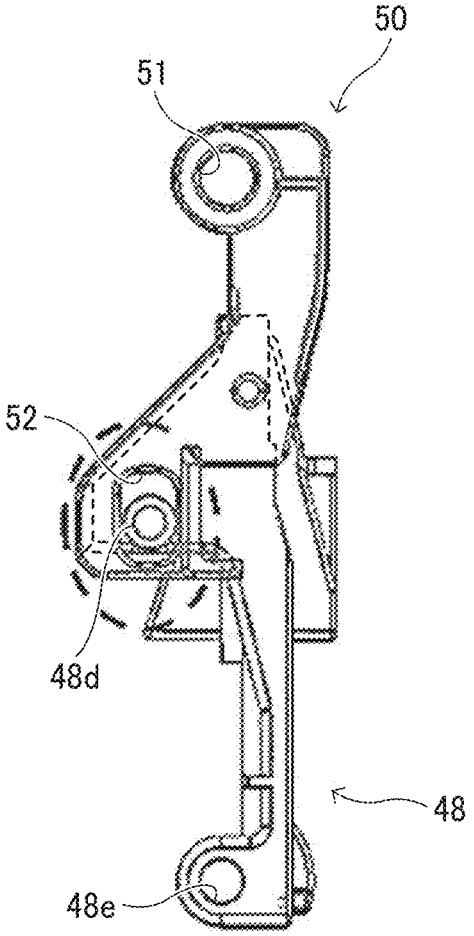

When the swing guide 48 rotates from the retracted position illustrated in FIG. 16A to the guide position illustrated in FIG. 16B, the link engaging projection 48*d* that is inserted through the guide engaging hole 52 of the link member 50 moves diagonally downward to the left, as indicated by arrow $X_1$ in FIG. 16A. On the other hand, when the swing guide 48 rotates from the retracted position to the guide position, the link member 50 rotates in the clockwise direction of FIG. 16A, so that the guide engaging hole 52 of the link member 50 moves diagonally upward to the left, as indicated by arrow $X_2$ in FIG. 16A. As a result, when the swing guide 48 rotates from the retracted position to the guide position, the direction of vertical movement of the guide engaging hole 52 is opposite to the direction of vertical movement of the link engaging projection 48*d*.

Therefore, in the present embodiment, the guide engaging hole 52 of the link member 50 is a long hole extending in the vertical direction. Accordingly, when the swing guide 48 rotates from the retracted position to the guide position, the link engaging projection 48*d* relatively moves in the guide engaging hole 52 in the vertical direction. As a result, the swing guide 48 smoothly rotates between the retracted position and the guide position.

Figure 17:
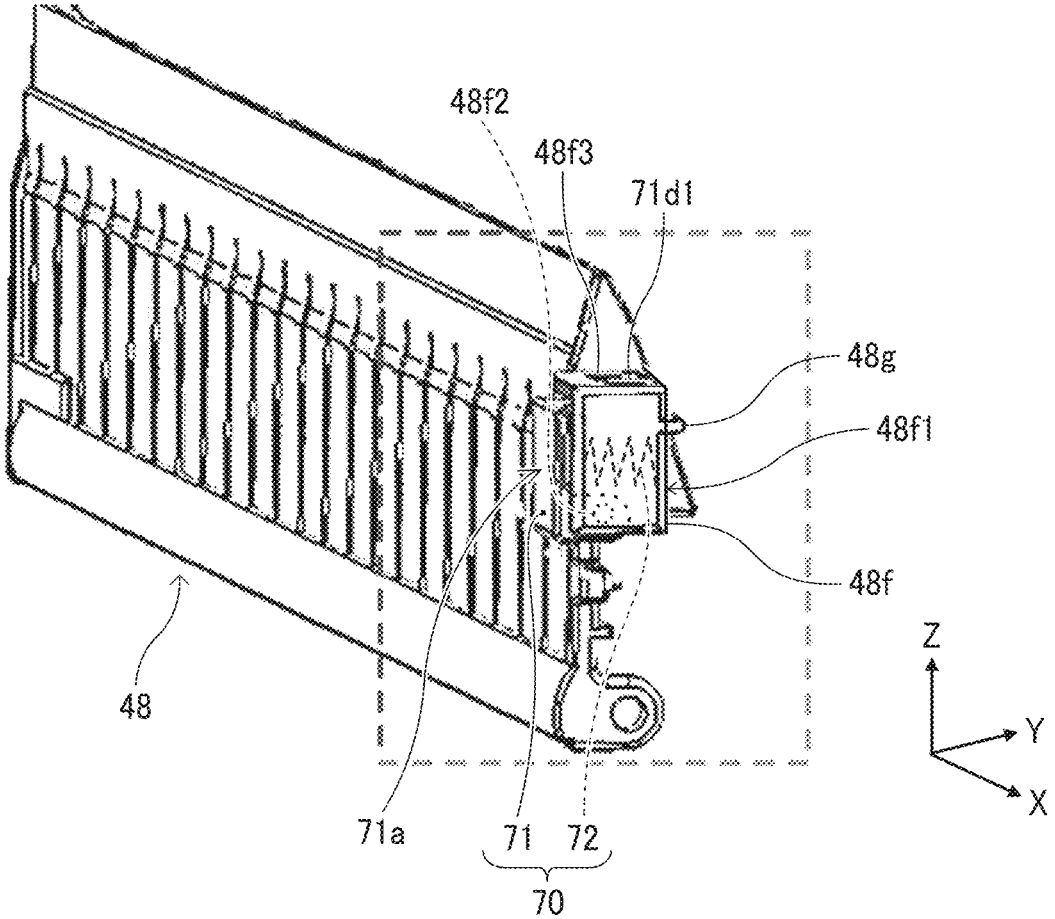
FIG. 17 is a perspective view illustrating the swing guide, viewed from the rear side of the image forming apparatus.
Figure 18:
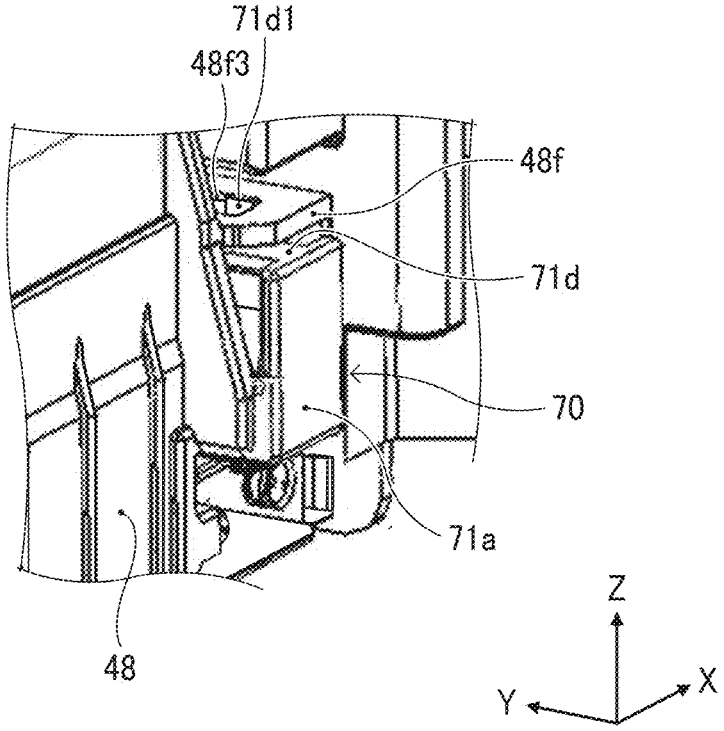
FIG. 18 is an enlarged view illustrating the area near a second biasing mechanism provided to the swing guide.
Figure 19:
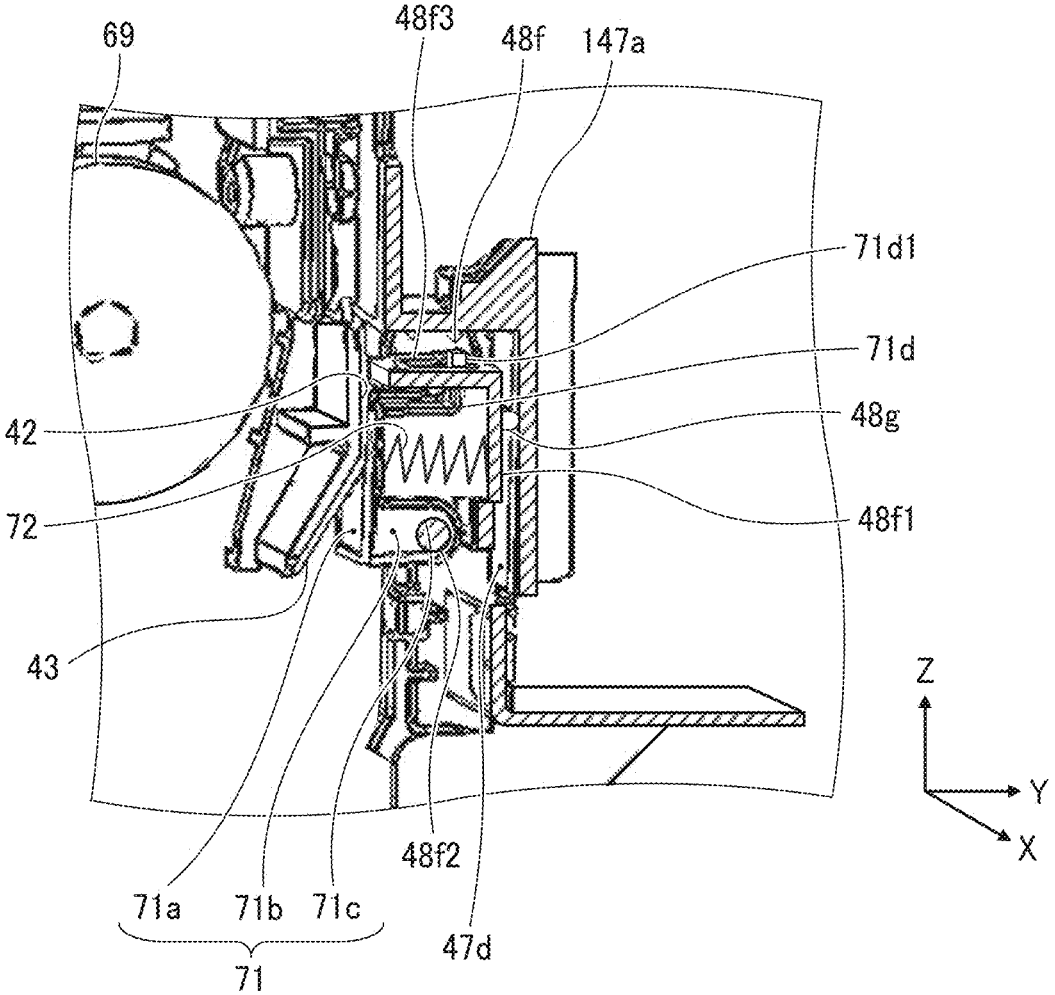
FIG. 19 is a sectional perspective view illustrating the swing guide in the area near a biasing mechanism container.

FIG. 17 is a perspective view illustrating the swing guide 48, viewed from the rear side of the image forming apparatus 100. FIG. 18 is an enlarged view illustrating the area near the second biasing mechanism 70 provided to the swing guide 48. FIG. 19 is a sectional perspective view illustrating the swing guide 48 in the area near a biasing mechanism container 48*f*.

The second biasing mechanism 70 is contained in the biasing mechanism container 48*f* mounted on the end portion of the rear side of the swing guide 48. The biasing mechanism container 48*f* includes an opposite face 48*f*1 is disposed facing the contact face 47*d* (see FIG. 19) of the rear side panel 147*a*. The opposite face 48*f*1 has a second positioning portion 48*g* projecting from the opposite face 48*f*1.

As illustrated in FIG. 19, the second biasing mechanism 70 includes a second pressing member 71 and a second compression spring 72. The second compression spring 72 is contained in the biasing mechanism container 48*f* in a compressed state. The second pressing member 71 includes a contact face 71*a* and an attaching portion 71*b*. The pressing portion 42 contacts the contact face 71*a*. The attaching portion 71*b* is disposed extending from both sides of the lower end portion of the contact face 71*a* in the X direction of the second pressing member 71 to the +Y direction. The biasing mechanism container 48*f* includes a support shaft 48*f*2 that passes through a support hole 71*c* formed at the tip of the attaching portion 71*b*. With this configuration, the second pressing member 71 is rotatably supported by the support shaft 48*f*2 as a fulcrum.

The second pressing member 71 includes a rotation regulating member 71*d* that extends from the upper end of the contact face 71*a* in the +Y direction. A projection 71*d*1 is projected upwardly at the tip of the rotation regulating member 71*d*. A through groove 48*f*3 extending in the Y direction is provided on top of the biasing mechanism container 48*f*. The projection 71*d*1 of the rotation regulating member 71*d* is inserted into the through groove 48*f*3. The projection 71*d*1 contacts the side end portion of the through groove 48*f*3 in the −Y direction of the through groove 48*f*3, rotation of the second pressing member 71 in the counter-clockwise direction in FIG. 19 is restricted. Accordingly, when the cover unit 130 is open, the second pressing member 71 is retained to the biasing mechanism container 48*f* with the upper end side of the second pressing member 71 is located further to the −Y direction (closer to the cover unit side) than the lower end side of the second pressing member 71, as illustrated in FIG. 18.

As illustrated in FIG. 19, when the rear side of the swing guide 48 is biased to the guide position side by the second biasing mechanism 70, the second positioning portion 48*g* contacts the contact face 47*d* provided on the rear side panel 147*a* to position the rear side of the swing guide 48. By so doing, similar to the positioning of the front side of the swing guide 48 illustrated in FIG. 13, a distance (gap) between the sheet feed guide 48*a* (see FIG. 10) on the rear side of the swing guide 48 and the sheet feed guide 149 (see FIG. 10) on the rear side of the swing guide 48 is set to a specified distance, and therefore the rear side of the sheet that has passed through the sheet separation nip region is guided by the sheet feed guide 149 and the sheet feed guide 48*a* reliably.

Figure 20B:
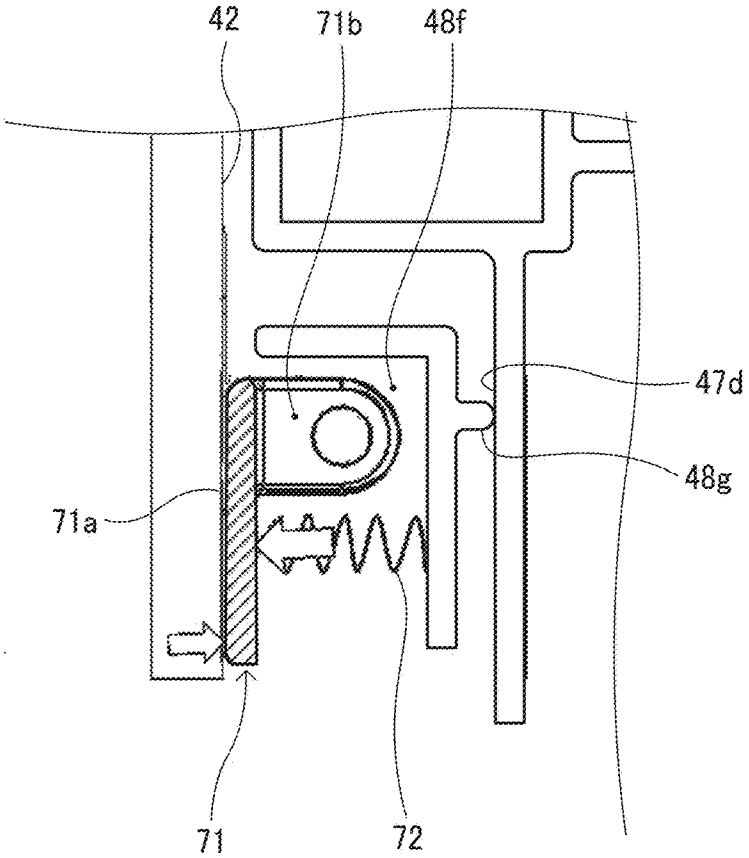
FIGS. 20A and 20B are diagrams of a modification for explaining rotation of a second pressing member of the second biasing mechanism in a case in which the rotational fulcrum of the second pressing member is provided on the upper side.
Figure 20A:
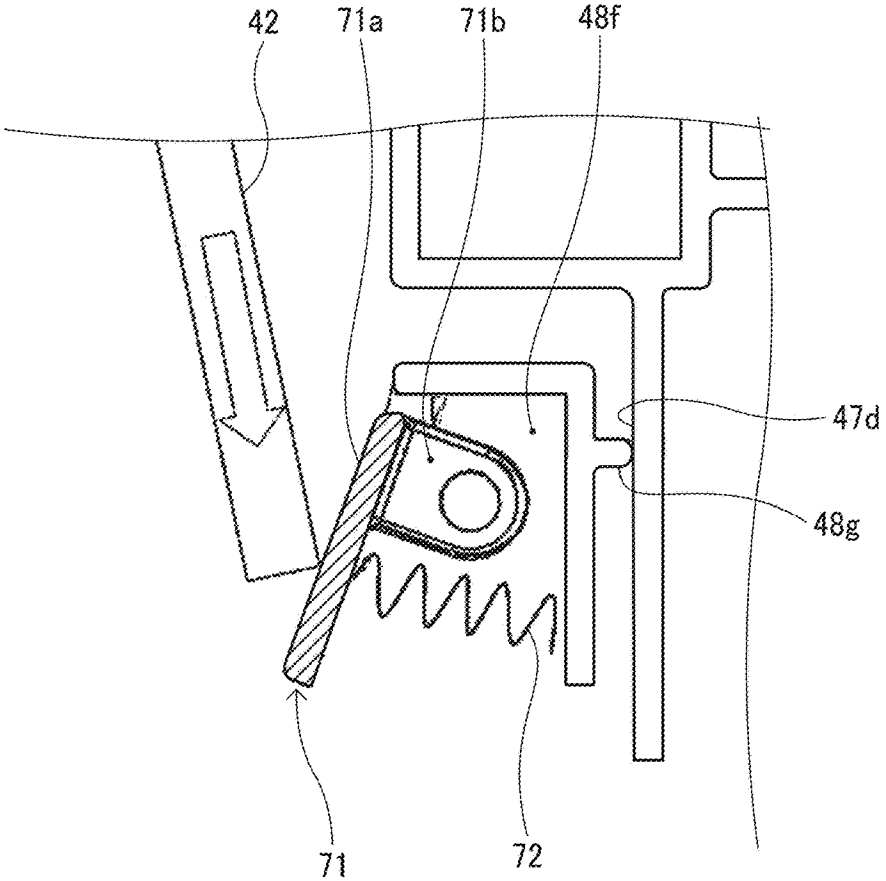

FIGS. 20A and 20B are diagrams of a modification for explaining rotation of the second pressing member 71 of the second biasing mechanism 70 in a case in which the rotational fulcrum of the second pressing member 71 is provided on the upper side.

In the modification illustrated in FIGS. 20A and 20B, the attaching portion 71*b* is provided on the upper part of the second pressing member 71, so that the rotation fulcrum of the second pressing member 71 is on the upper side of the second pressing member 71. With this configuration, as illustrated in FIG. 20A, the pressing portion 42 contacts the contact face 71*a* of the second pressing member 71 without providing the slant portion 43 on the guide member 40 side as illustrated in FIG. 19.

Figure 21B:
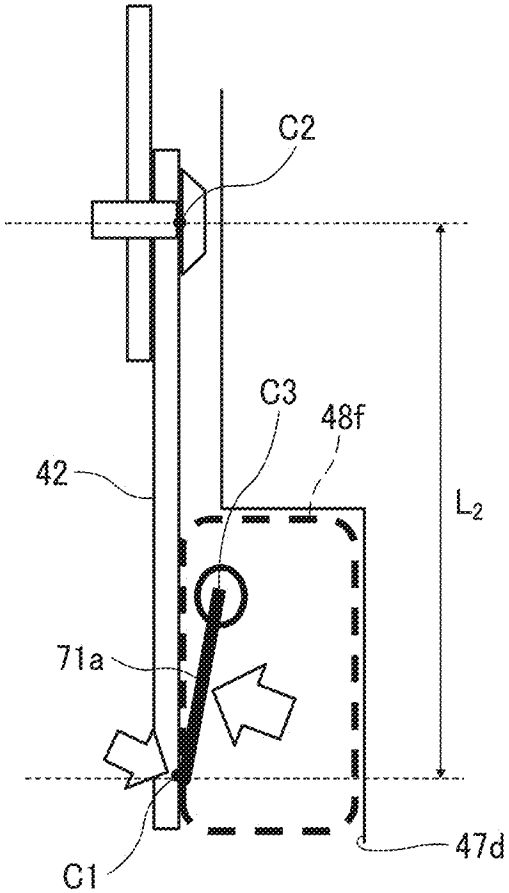
FIG. 21B is diagram for explaining the biasing position of the spring to the guide member when the rotation fulcrum of the second pressing member is provided at the upper portion.
Figure 21A:
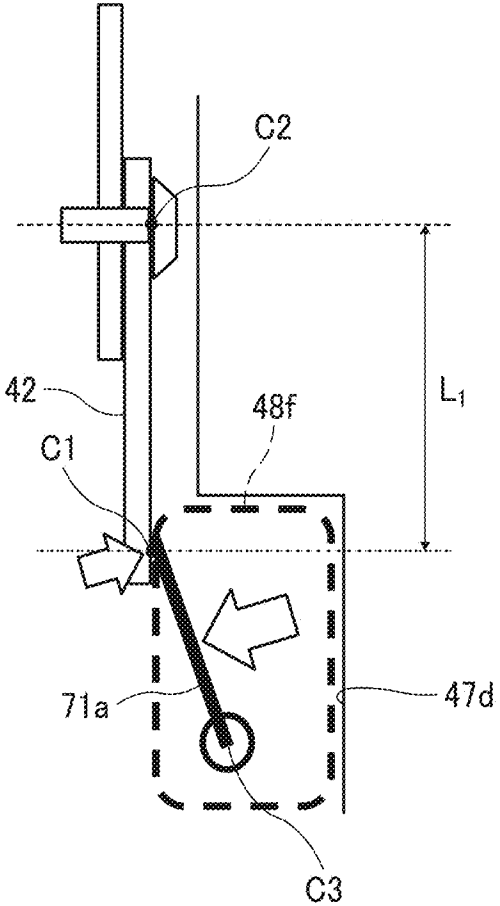
FIG. 21A is a diagram for explaining a biasing position of a spring to the guide member when the rotation fulcrum of the second pressing member is provided at the lower portion.

On the other hand, a description is given of the effects of the configuration with the rotation fulcrum of the second pressing member 71 at the lower portion of the second pressing member 71 as illustrated in FIG. 21A and the configuration with the rotation function of the second pressing member 71 at the upper portion of the second pressing member 71 as illustrated in FIG. 21B, according to the present embodiment.

FIG. 21A is a diagram illustrating the configuration according to the present embodiment for explaining the biasing position of the second compression spring 72 to the guide member 40 when the rotation fulcrum of the second pressing member 71 is provided at the lower portion of the second pressing member 71. FIG. 21B is diagram illustrating the configuration according to the present embodiment for explaining the biasing position of the second compression spring 72 to the guide member 40 when the rotation fulcrum of the second pressing member 71 is provided at the upper portion of the second pressing member 71.

In FIGS. 21A and 21B, reference letter C1 represents a position at which the biasing force of the second compression spring 72 is applied to the guide member 40 via the second pressing member 71 when the cover unit 130 is closed, reference letter C2 represents a fixing portion at which the guide member 40 is fixed to the cover unit 130, and reference letter C3 represents a rotation fulcrum of the second pressing member 71.

As illustrated in FIGS. 21A and 21B, a distance from the position C1 to the fixing portion C2 is shorter in the configuration in which the rotation fulcrum C3 of the second pressing member 71 is at the lower portion (FIG. 21A), than in the configuration in which the rotation fulcrum C3 of the second pressing member 71 is at the upper portion (FIG. 21B). To be more specific, a distance $L_2$ from the position C1 to the fixing portion C2 in the configuration in which the rotation fulcrum C3 of the second pressing member 71 is at the lower portion (FIG. 21A) is shorter than a distance $L_1$ from the position C1 to the fixing portion C2 in the configuration in which the rotation fulcrum C3 of the second pressing member 71 is at the upper portion (FIG. 21B). As a result, when compared with the configuration in which the rotation fulcrum C3 of the second pressing member 71 is at the upper portion (FIG. 21B), the configuration in which the rotation fulcrum C3 of the second pressing member 71 is at the lower portion (FIG. 21A) reduces the stress (shearing stress) applied to the guide member 40, and therefore deformation of the guide member 40 to the cover unit 130 side (in other words, in the −Y direction) is restrained.

In addition, by providing the rotation fulcrum of the second pressing member 71 at the upper portion, when the pressing portion 42 slides on the (lower) end portion of the contact face 71*a* in the closing movement of the cover unit 130, in a case in which the end portion of the contact face 71*a* is pulled in the moving direction of the pressing portion 42 due to sliding resistance, the end portion of the contact face 71*a* causes the second pressing member 71 to rotate in a direction away from the pressing portion 42. As a result, an increase in contact pressure of the pressing portion 42 and the end portion of the contact face 71*a* is restrained, and therefore the pressing portion 42 slides on the end portion of the contact face 71*a* smoothly.

By contrast, in the opening movement of the cover unit 130, in a case in which the end portion of the contact face 71*a* is pulled in the moving direction of the pressing portion 42 due to sliding resistance, the end portion of the contact face 71*a* causes the second pressing member 71 to rotate in a direction to increase the contact pressure of the end portion of the contact face 71*a* and the pressing portion 42, thereby increasing the sliding resistance. Therefore, the configuration in which the rotation fulcrum C3 of the second pressing member 71 is at the upper portion is not effective when the cover unit 130 is opened.

On the other hand, the configuration in which the rotation fulcrum C3 of the second pressing member 71 is at the lower portion of the second pressing member 71 has the opposite relation to the configuration in which the rotation fulcrum C3 of the second pressing member 71 is at the upper portion of the second pressing member 71. Accordingly, in the opening movement of the cover unit 130, an increase in contact pressure of the end portion of the contact face 71*a* with the pressing portion 42 is restrained, and therefore the pressing portion 42 slides on the end portion of the contact face 71*a*. By contrast, in the closing movement of the cover unit 130, the contact pressure of the end portion of the contact face 71*a* and the pressing portion 42 increases, and therefore the sliding resistance also increases.

Therefore, whether the rotation fulcrum of the second pressing member 71 is located at the upper portion or the lower portion may be determined according to the sliding resistance of the first pressing portion 61 (see FIG. 14) and the pressing member 41 (see FIG. 14). For example, when the sliding resistance between the first pressing portion 61 and the pressing member 41 in the closing movement of the cover unit 130 is greater than the sliding resistance between the first pressing portion 61 and the pressing member 41 in the opening movement of the cover unit 130, the configuration in which the rotation fulcrum of the second pressing member 71 is at the upper portion is employed to restrain an increase in sliding resistance in the closing movement of the cover unit 130. On the other hand, when the sliding resistance between the first pressing portion 61 and the pressing member 41 in the opening movement of the cover unit 130 is greater than the sliding resistance between the first pressing portion 61 and the pressing member 41 in the closing movement of the cover unit 130, the configuration in which the rotation fulcrum of the second pressing member 71 is at the lower portion is employed to restrain an increase in sliding resistance in the opening movement of the cover unit 130.

Figure 22A:
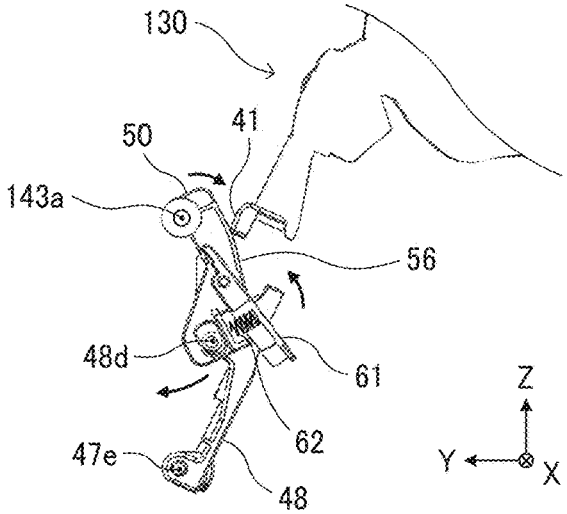
FIGS. 22A, 22B, and 22C are diagrams illustrating the swing guide rotating from the retracted position to the guide position along with a closing movement of the cover unit.
Figure 22B:
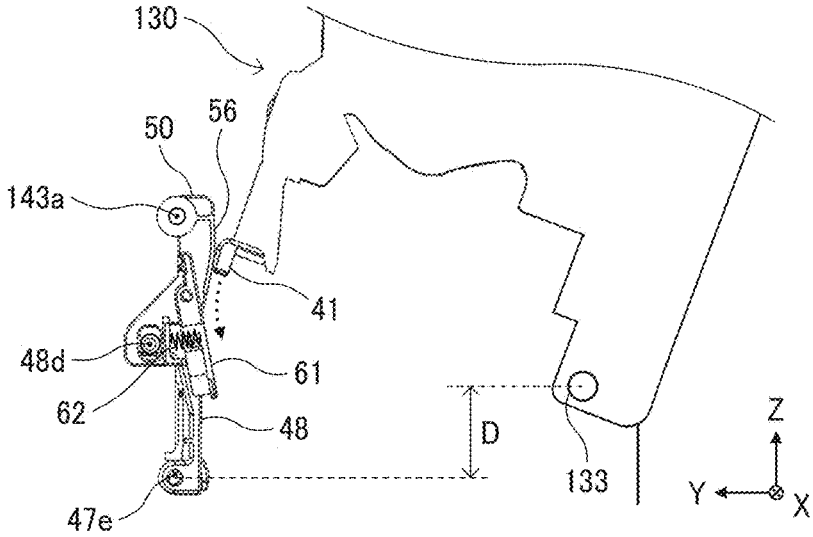
Figure 22C:
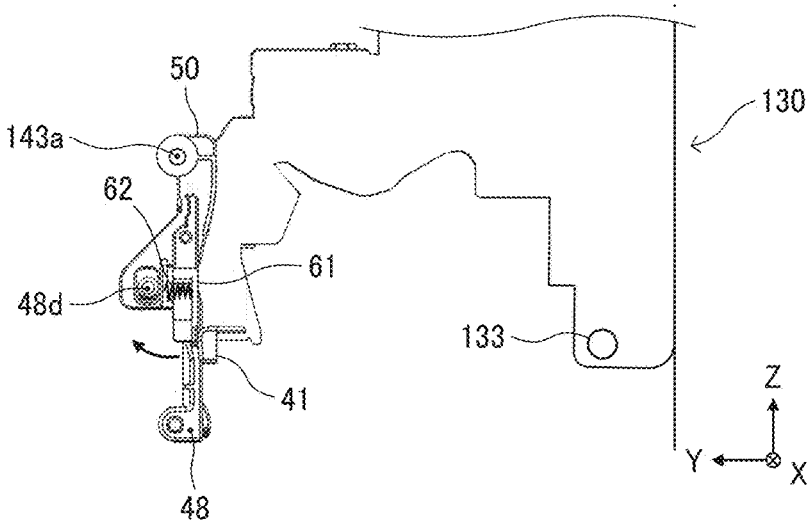

FIGS. 22A, 22B, and 22C are diagrams illustrating the swing guide 48 rotating from the retracted position to the guide position along with the closing movement of the cover unit 130.

In FIGS. 22A, 22B, and 22C, both the swing guide 48 and the cover unit 130 rotate with the lower portion as a rotation as a fulcrum. In FIG. 22B, the rotation fulcrum (the swing shafts 47*e*) of the swing guide 48 and the rotation fulcrum (the support shaft 133) of the cover unit 130 are spaced apart by a distance D. Therefore, in the vertical direction, the rotation fulcrum (the support shaft 133) of the cover unit 130 is relatively close to the rotation fulcrum (the swing shafts 47*e*) of the swing guide 48.

In the vertical direction, the rotation fulcrum (the support shaft 133) of the cover unit 130 is disposed close to the rotation fulcrum (the swing shafts 47*e*) of the swing guide 48, the moving direction of the pressing member 41 near the swing guide 48 is substantially vertically downward, which is the direction intersecting the rotational direction of the swing guide 48 (in other words, the direction substantially orthogonal to the rotational direction of the swing guide 48).

As illustrated in FIG. 22A, when the swing guide 48 is at the retracted position, the lower end of the link member 50 is located closer to the cover unit 130 than the upper end of the link member 50. The link member 50 is retained by the link retaining shaft 143*a* and the link engaging projection 48*d* with being inclined with respect to the vertical direction.

As the cover unit 130 is brought toward the closed position, the pressing member 41 moves from the upward side that is the open side of the swing guide 48 to the downward side in the substantially vertical direction, so contacts the contact face 56 of the link member 50. In the present embodiment, as described above, when the swing guide 48 is in the retracted position, the link member 50 is inclined with respect to the vertical direction. Since the position of pressing member 41 is slightly shifted in the left or right direction (the horizontal direction) in FIG. 22A due to manufacturing error or assembly error, pressing member 41 is brought to contact the link member 50.

After the pressing member 41 has contacted the contact face 56 of the link member 50, as the cover unit 130 is further brought toward the closed position, the pressing member 41 slides on the contact face 56 while pressing the link member 50 downward. As the pressing member 41 presses the link member 50 downward, the link member 50 rotates about the link retaining shaft 143*a* as the rotational fulcrum in the clockwise direction in FIG. 22A.

In the present embodiment, the upper end of the link member 50 that functions as the rotation fulcrum is disposed upstream in the moving direction of pressing member 41 from the opposite end of the link member 50 that is engaged with the swing guide 48 and the lower end of the link member 50 is inclined to the vertical direction so as to be located closer to the cover unit 130 than the upper end of the link member 50. With this configuration, when the pressing member 41 presses the link member 50 downward along with movement of the cover unit 130, the link member 50 rotates in the clockwise direction in FIG. 22A.

With rotation of the link member 50 in the clockwise direction in FIG. 22A, the lower end (the opposite end) of the link member 50 moves toward the guide position. Due to the movement of the lower end of the link member 50, the link engaging projection 48*d* of the swing guide 48 that is engaged with the lower end of the link member 50 is pressed by the link member 50 toward the guide position, and therefore the swing guide 48 rotates from the retracted position to the guide position. As described above, the link member 50 converts the downward pressing force of the pressing member 41 into the pressing force to press the swing guide 48 toward the guide position. Accordingly, the swing guide 48 is smoothly rotated from the retracted position to the guide position. As a result, the cover unit 130 is prevented from rotating (moving) slow in the closing movement of the cover unit 130, and therefore the cover unit 130 is closed smoothly.

Further, in the present embodiment, since the contact face 56 of the link member 50 to which pressing member 41 contact has a convex surface, the amount of rotation of the link member 50 with respect to the amount of movement of pressing member 41 toward downward along with the closing movement of the cover unit 130 is reduced when compared with the configuration in which the contact face 56 has a flat surface. As a result, the rotation speed of the swing guide 48 from the retracted position to the guide position is reduced, and therefore the first positioning portion 48*c* (see FIG. 8) and the second positioning portion 48*g* (see FIG. 17) of the swing guide 48 are prevented from contacting the contact face of the sheet feeding device 47 with great force when the swing guide 48 reaches the guide position. Accordingly, this configuration prevents occurrence of noise and damage on the first positioning portion 48*c* (see FIG. 8) and the second positioning portion 48*g* (see FIG. 17) of the swing guide 48.

As illustrated in FIG. 22B, after the swing guide 48 has reached the guide position and as the cover unit 130 is further closed, the pressing member 41 contacts the first pressing portion 61 of the first biasing mechanism 60.

As illustrated in FIG. 22B, the lower end of the first pressing portion 61 is located closer to the cover unit 130 than the upper end of the first pressing portion 61, and the first pressing portion 61 is retained by the link member 50 with being inclined with respect to the vertical direction. Therefore, even when the position of the pressing member 41 is slightly shifted in the right direction in FIG. 22B due to manufacturing error or assembly error, the pressing member 41 is brought to contact the first pressing portion 61.

After the pressing member 41 has contacted the first pressing portion 61 of the first biasing mechanism 60, as the cover unit 130 is further brought toward the closed position, the pressing member 41 slides on the surface of the first pressing portion 61 while pressing the first pressing portion 61 downward. As the pressing member 41 presses the first pressing portion 61 downward, the first pressing portion 61 rotates in the clockwise direction in FIG. 22B against the biasing force of the first compression spring 62.

In the present embodiment, the rotation fulcrum of the first pressing portion 61 is disposed upstream in the moving direction of the pressing member 41 when the pressing member 41 contacts the first pressing portion 61, from the contact portion of the first pressing portion 61 to contact the pressing member 41. At the same time, the lower end of the first pressing portion 61 is inclined to the vertical direction so as to be located closer to the cover unit 130 than the upper end of the first pressing portion 61. Therefore, when the pressing member 41 presses the first pressing portion 61 downward along with the closing movement of the cover unit 130, the first pressing portion 61 rotates in the clockwise direction in FIG. 22B. Then, as illustrated in FIG. 22C, the cover unit 130 is closed in a state in which the pressing member 41 is in contact with the first pressing portion 61.

In the present embodiment, as described above, the pressing member 41 slides on the link member 50 and the surface of the first pressing portion 61. Therefore, it is preferable that the link member 50 and the first pressing portion 61 are made of a sliding material such as POM (polyacetal resin). By forming the link member 50 and the first pressing portion 61 with sliding material, the pressing member 41 slides on the link member 50 and the surface of the first pressing portion 61 smoothly, and therefore the cover unit 130 is closed with light force. In particular, when the pressing member 41 slides on the surface of the first pressing portion 61, the biasing force of the first compression spring 62 acts, providing large sliding resistance. Therefore, it is particularly effective and preferable that the first pressing portion 61 is made of a sliding material.

Further, a sliding sheet may be attached to the contact face 56 of the link member 50 or the sliding surface of the first pressing portion 61 (that functions as a slider portion) on which the pressing member 41 slides. Further, the pressing member 41 may be made of a sliding material to obtain the same effect.

Figure 23:
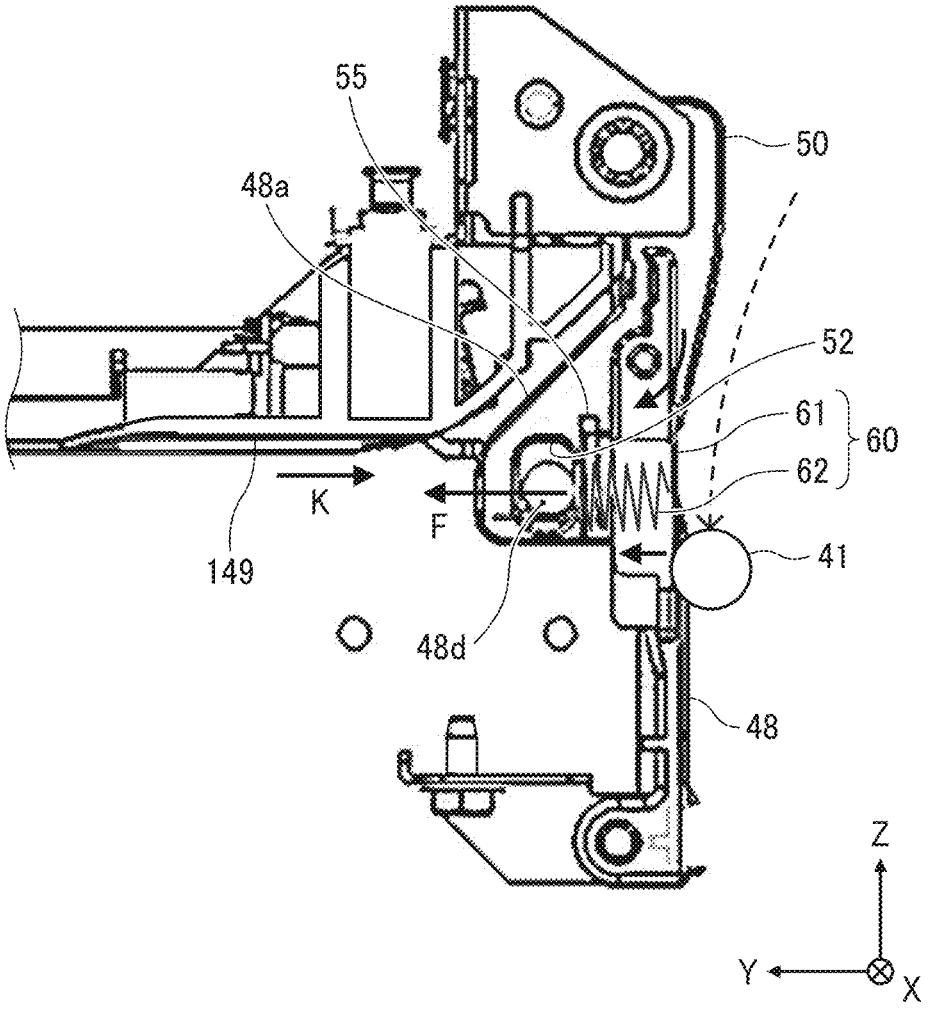
FIG. 23 is a diagram illustrating the link member, the swing guide, a first biasing mechanism, and a sheet feeding guide, when the cover unit is closed.

FIG. 23 is a diagram illustrating the link member 50, the swing guide 48, the first biasing mechanism 60, and the sheet feed guide 149, when the cover unit 130 is closed.

As illustrated in FIG. 23, even when the cover unit 130 is closed, the pressing member 41 is in contact with the first pressing portion 61, thereby regulating the first pressing portion 61 from rotating in the counterclockwise direction in FIG. 23. As a result, the first compression spring 62 maintains the given amount of compression, so that the given biasing force is added to the spring holder 55 of the link member 50. As a result, the link member 50 is biased by the first compression spring 62 to rotate in the clockwise direction in FIG. 23. Consequently, the link engaging projection 48*d* of the swing guide 48, which is passed through the guide engaging hole 52, is pressed by the inner circumferential surface of the guide engaging hole 52 in a direction indicated by arrow F in FIG. 23. As a result, the swing guide 48 is biased via the link member 50 in the rotational direction to the guide position (in other words, the +Y direction), that is, the clockwise direction in FIG. 23.

In the present embodiment, as illustrated in FIG. 23, the spring holder 55 of the link member 50 is provided closer to the cover unit 130 (to the right side in FIG. 23) than the guide engaging hole 52. Due to this configuration, when the swing guide 48 is at the guide position, the spring holder 55 is disposed parallel to the vertical direction. Accordingly, the direction of the biasing force received from the first compression spring 62 is substantially parallel to a sheet conveyance direction K of the sheet.

Figure 24A:
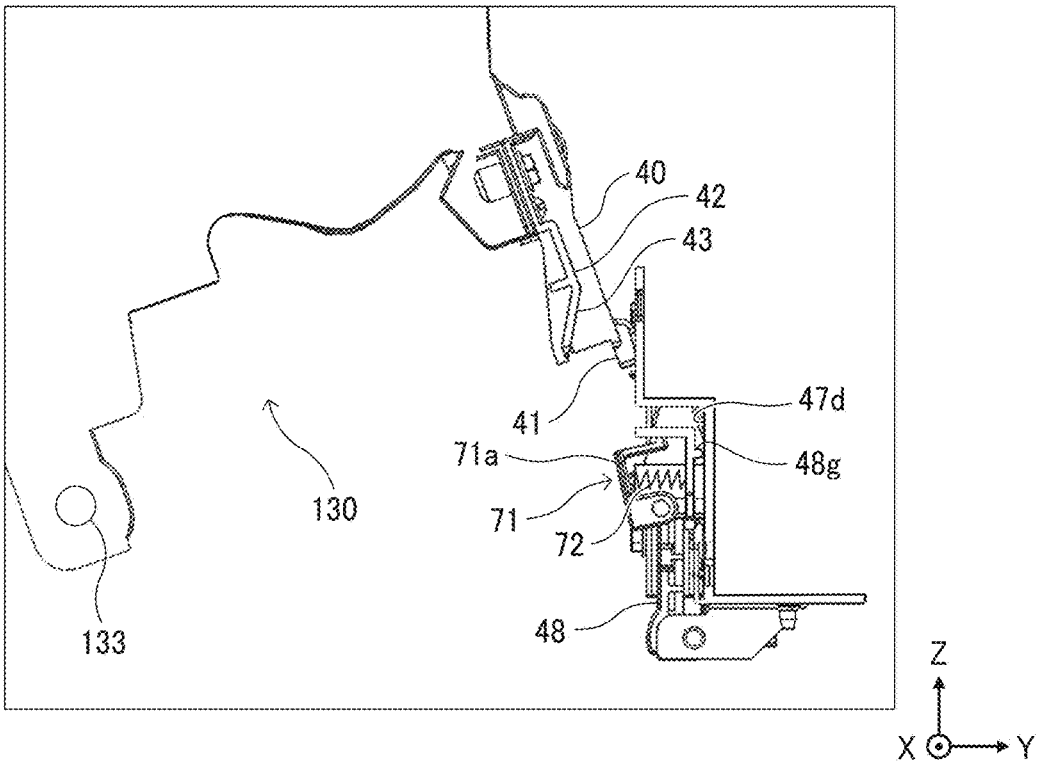
FIGS. 24A and 24B are diagrams illustrating the rear side of the image forming apparatus, when the swing guide rotates from the retracted position to the guide position along with the closing movement of the cover unit.
Figure 24B:
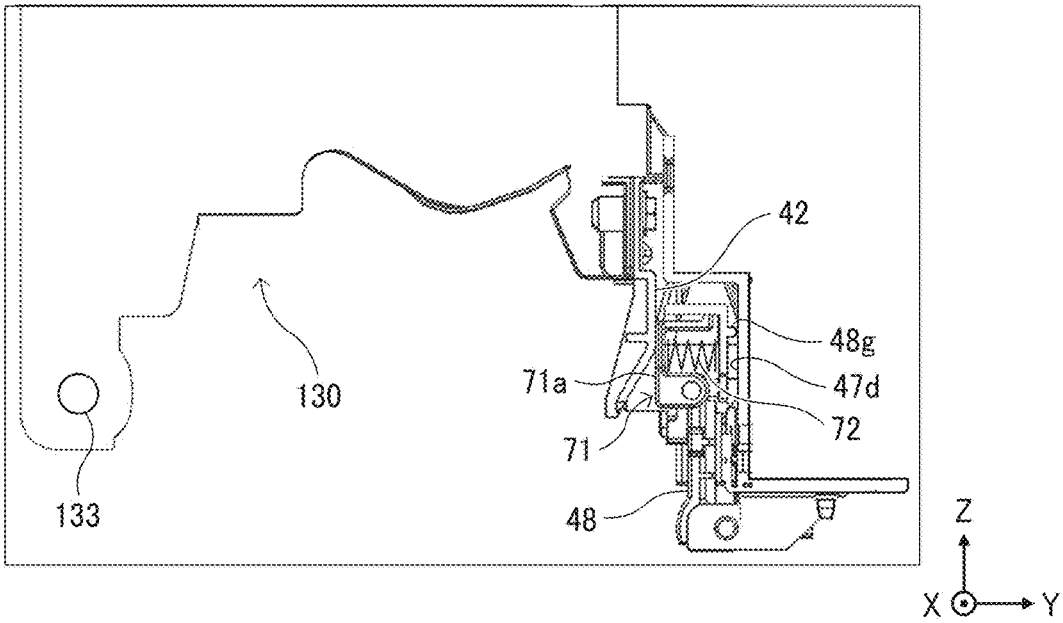

FIGS. 24A and 24B are diagrams illustrating the rear side of the image forming apparatus 100, when the swing guide 48 rotates from the retracted position to the guide position along with the closing movement of the cover unit 130. To be more specific, FIG. 24A illustrates the rear side of the image forming apparatus 100 in the state of FIG. 22B viewed from the rear side and FIG. 24B illustrates the rear side of the image forming apparatus 100 in the state of FIG. 22C viewed from the rear side.

As illustrated in FIG. 24A, when the pressing member 41 presses the link member 50 to rotate the swing guide 48 to the guide position (see FIG. 22B), the slant portion 43 of the guide member 40 and the second pressing member 71 are separated from each other.

As the cover unit 130 is further closed from the state of FIG. 24A, the slant portion 43 of the guide member 40 contacts the upper end of the second pressing member 71. As the cover unit 130 is further closed from the state in which the slant portion 43 of the guide member 40 contacts the upper end of the second pressing member 71, the upper end of the second pressing member 71 is pressed in the +Y direction by the slant portion 43 of the guide member 40. Consequently, while the second pressing member 71 rotates in the clockwise direction against the biasing force of the second compression spring 72, the upper end of the second pressing member 71 relatively moves toward the pressing portion 42 while sliding on the slant portion 43. Then, when the upper end of the second pressing member 71 rides on the pressing portion 42, the pressing portion 42 moves downward while sliding on the contact face 71*a* of the second pressing member 71. Then, as illustrated in FIG. 24B, the cover unit 130 is closed in a state in which the pressing portion 42 is in contact with the second pressing member 71.

On the rear side of the image forming apparatus 100, the slant portion 43 and the pressing portion 42 slide on the second pressing member 71. Further, when the slant portion 43 and the pressing portion 42 slide on the second pressing member 71, the biasing force of the second compression spring 72 acts, providing large sliding resistance. Therefore, similar to the first pressing portion 61, it is preferable that the second pressing member 71 is made of a sliding material such as POM (polyacetal resin). Accordingly, the slant portion 43 and the pressing portion 42 slides on the contact face of the second pressing member 71 smoothly, and therefore the cover unit 130 is closed with light force. Further, a sliding sheet may be attached to the contact face 71*a* of the second pressing member 71. Further, the slant portion 43 and the pressing portion 42 may be made of sliding material or a sliding sheet may be attached to the sliding face of the slant portion 43 and the sliding face of the pressing portion 42 to the second pressing member 71.

In this example, as illustrated in FIG. 24A, while the second positioning portion 48*g* is in contact with the contact face 47*d* and after the swing guide 48 has reached the guide position, the slant portion 43 contacts the second pressing member 71. However, the timing at which the slant portion 43 comes into contact with the second pressing member 71 may be after the pressing member 41 contact the link member 50. For example, when the swing guide 48 moves to the guide position by some extent, the slant portion 43 may contact the second pressing member 71.

As illustrated in FIG. 24B, in the state in which the cover unit 130 is closed, the pressing portion 42 contacts the second pressing member 71 to regulate rotation of the second pressing member 71 in the counterclockwise direction in FIG. 24B. As a result, the second compression spring 72 maintains the given amount of compression, so that the given biasing force is added to the swing guide 48. Consequently, the swing guide 48 on the rear side is also biased in the rotational direction to the guide position (in other words, the +Y direction), that is, the clockwise direction in FIG. 24B.

After having passed through the sheet separation nip region, as illustrated in FIG. 10, the leading end of the sheet contacts the sheet feed guide 48*a* of the swing guide 48, so is guided by the sheet feed guide 48*a* in the vertically upward direction. When the leading end of the sheet contacts the sheet feed guide 48*a* of the swing guide 48, the swing guide 48 is pressed in a direction to rotate toward the retracted position (in other words, the −Y direction). In the present embodiment, as described above, the first biasing mechanism 60 (see FIG. 9) and the second biasing mechanism 70 (see FIG. 9) bias the front and rear sides of the swing guide 48 in a direction to rotate toward the guide position (in other words, the +Y direction). With this configuration, even though the leading end of the sheet that has passed through the sheet separation nip region contacts the sheet feed guide 48*a* of the swing guide 48, the swing guide 48 does not rotate toward the retracted position, and therefore the sheet after the sheet separation nip region is guided in the vertically upward direction reliably.

Further, by biasing the front and rear sides of the swing guide 48 in the direction to rotate to the guide position (in other words, the +Y direction), when the leading end of the sheet contacts the sheet feed guide 48*a* of the swing guide 48, the swing guide 48 does not incline in the X direction, thereby preventing occurrence of skew on the sheet conveyed from the sheet separation nip region.

In the present embodiment, by providing the link member 50, the angle of the trajectory of movement of the opposite end of the link member 50 and the rotational direction of the swing guide 48 is smaller than the angle of the trajectory of movement of pressing member 41 and the rotational direction of the swing guide 48. By so doing, the swing guide 48 is rotated from the retracted position to the guide position smoothly.

Figure 25B:
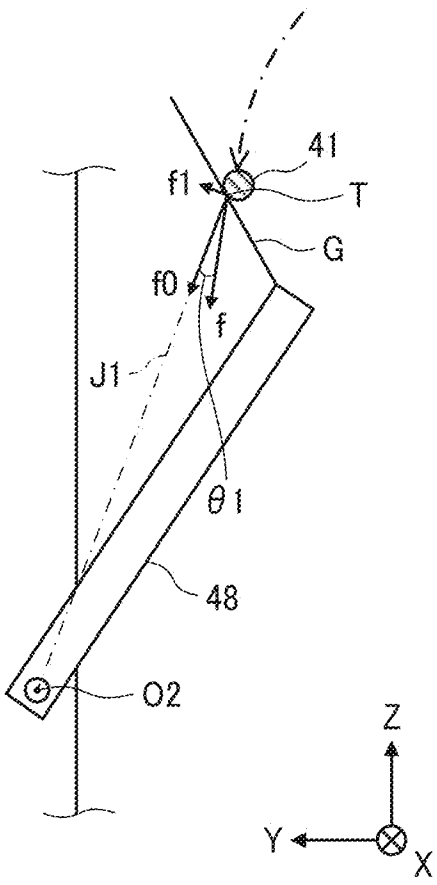
FIG. 25B is a diagram illustrating direction of force to the guide member and the pressing portion when the pressing portion contacts the guide member provided at the tip of the swing guide.
Figure 25A:
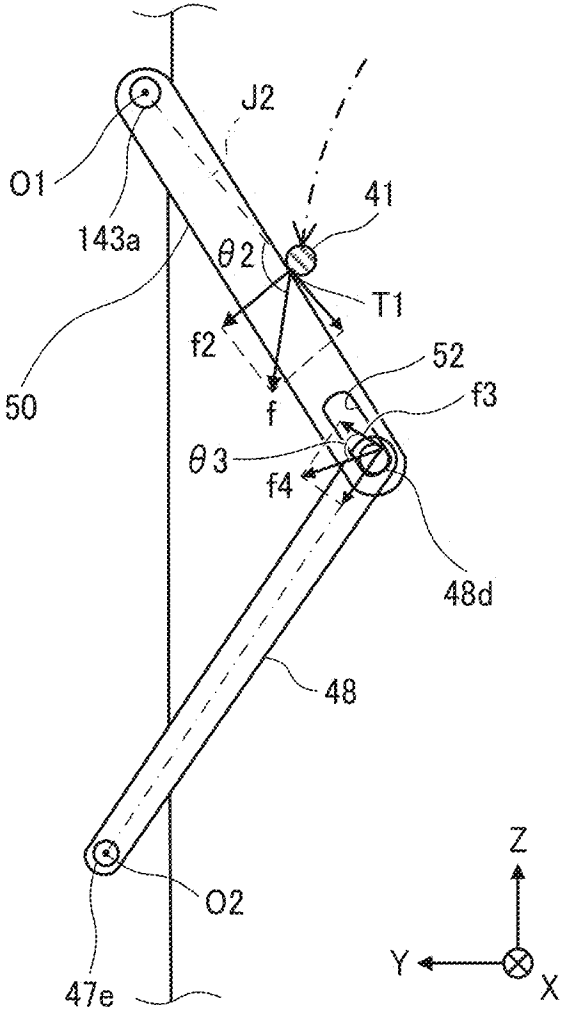
FIG. 25A is a diagram illustrating directions of force to the link member and a pressing portion when the pressing portion contacts the link member.

Next, a description is given of the detailed configurations, with reference to FIGS. 25A and 25B.

In the present embodiment, as indicated by broken lines illustrated in FIGS. 25A and 25B, the moving direction of pressing member 41 when the cover unit 130 is closed is a direction intersecting the rotational direction of the swing guide 48 (in other words, a direction substantially perpendicular to the rotational direction of the swing guide 48, that is, the angle of the line of the trajectory of movement of pressing member 41 and the line of the rotational direction of the swing guide 48 is substantially 90 degrees), and the pressing member 41 is moved from the open side (from above). Therefore, if there is no link member 50 as illustrated in FIG. 25A or a sloped guide portion G provided at the tip of the swing guide 48 as illustrated in FIG. 25B, when the cover unit 130 is closed with the swing guide 48 located at the retracted position (that is, the cover unit 130 is open), the guide member 40 (see FIG. 5) provided on the cover unit 130 enters between the swing guide 48 and the housing of the sheet feeding device 47. Therefore, the cover unit 130 is not closed. In addition, as the guide member 40 enters between the swing guide 48 and the housing of the sheet feeding device 47, the swing guide 48 may be damaged.

By providing the guide portion G as illustrated in FIG. 25B, the pressing member 41 is brought to contact with the guide portion G. Simultaneously, by pressing the guide portion G downward by the pressing member 41, a component force f1 directing in the direction to rotate the swing guide 48 to the guide position is generated, as illustrated in FIG. 25B. However, the angle θ1 of the line of the pressing direction of the pressing member 41 and a line segment J1 connecting a rotation fulcrum O2 of the member (the swing guide 48) that rotates by pressing force f of the pressing member 41 and a pressing position T is an acute angle (small angle). Therefore, the substantially whole amount of the pressing force f is turned to a force f0 directing toward the rotation fulcrum O2, and the amount of force f1 in a direction to rotate the swing guide 48 to the guide position (in other words, the +Y direction) is little. As a result, a large amount of force is to be applied to rotate the swing guide 48, and the cover unit 130 does not close smoothly. In addition, it is likely that the guide portion G is deformed.

By contrast, as illustrated in FIG. 25A, by providing the link member 50 and locating the rotation fulcrum of the link member 50 on the upstream side in the moving direction of the pressing member 41, the angle θ2 of the line of the pressing direction of the pressing member 41 and a line segment J2 connecting a rotation fulcrum O1 of the member (the link member 50) that rotates by the pressing force f of the pressing member 41 and a pressing position T1 is an obtuse angle (large angle). As a result, as illustrated in FIG. 25A, a component force f2 of the pressing force f is sufficiently obtained in a direction to rotate the link member 50.

Further, the angle θ3 of the line of pressing force in the pressing direction in which the link member 50 presses (the link engaging projection 48*d* of) the swing guide 48 (in other words, a pressing force f4 in the moving direction of the opposed end of the link member 50) and the line of component force f3 in the rotational direction of the link engaging projection 48*d* to the guide position is an acute angle (in other words, an angle less than 90 degrees). As a result, the pressing force f4 by which the link member 50 presses (the link engaging projection 48*d* of) the swing guide 48 sufficiently provides the component force f3 in the moving direction of the link engaging projection 48*d* when the swing guide 48 rotates to the guide position. Accordingly, the link engaging projection 48*d* of the swing guide 48 relatively moves in the guide engaging hole 52 by the component force f3 so as to rotate the swing guide 48 to the guide position.

Thus, by providing the link member 50, even if the moving direction of the pressing member 41 when closing the cover unit 130 is equal to the direction intersecting the rotational direction of the swing guide 48 (the direction substantially perpendicular to the rotational direction of the swing guide 48), the swing guide 48 is moved to the guide position with light force, and therefore the cover unit 130 is closed smoothly.

Note that the rotation fulcrum of one end of the link member 50 in the present embodiment is provided further upward compared with the rotation fulcrum of one end of the link member 50 illustrated in FIG. 25A and the engagement position at the opposite end of the link member 50 where the link member 50 engages with the swing guide 48 in the present embodiment is provided farther in the +Y direction side compared with the engagement position at the opposite end of the link member 50 in FIG. 25A. By so doing, the pressing direction in which the link member 50 presses (the link engaging projection 48*d* of) the swing guide 48 (in other words, the moving direction of the opposite end of the link member 50) is substantially on the same side as the moving direction of the link engaging projection 48*d* when the swing guide 48 is rotated to the guide position. Accordingly, the swing guide 48 is rotated to the guide position more smoothly.

Further, when the swing guide 48 rotates from the retracted position to the guide position, the weight of the swing guide 48 alone acts on the swing guide 48 as force in the direction to swing back to the retracted position (in other words, the −Y direction). Therefore, the swing guide 48 is rotated from the retracted position to the guide position with relatively small force. This is another fact to cause the cover unit 130 to be closed smoothly. As described above, since the swing guide 48 is rotated from the retracted position to the guide position with relatively small force, even if the link member 50 is provided on the front side alone to press the swing guide 48 to the guide position by one side alone (the front side) of the image forming apparatus 100, the swing guide 48 is rotated from the retracted position to the guide position. As described above, since the link member 50 is provided on one side alone in the front-and-rear direction (in other words, the X direction) of the image forming apparatus 100, the number of parts is reduced, and therefore a reduction in size and cost of the sheet guiding device 74 and the image forming apparatus 100.

Further, in the present embodiment, the opposite end of the link member 50 is constantly in engagement with the swing guide 48. However, for example, when the swing guide 48 is at the retracted position, the opposite end of the link member 50 may be disengaged from (may not be engaged with) the swing guide 48. In this configuration, when the pressing member 41 contacts the link member 50 to rotate the link member 50 by a certain amount, the opposite end of the link member 50 engages with the swing guide 48, so that the link member 50 causes the swing guide 48 to rotate to the guide position. In other words, after the pressing member 1 has contacted the link member 50 to change a position of the link member 50, the opposite end of the link member 50 moves in the same direction as the rotational direction of the swing guide 48.

Further, the link member 50 may be disengaged from the swing guide 48 when the swing guide 48 is at the guide position. In this configuration, for example, as the swing guide 48 is rotated from the guide position to the retracted position, the link member 50 comes to engage with the swing guide 48. Then, as the link member 50 causes the swing guide 48 to rotate from the retracted position to the guide position to some extent, the pressing member 41 contacts the first pressing portion 61 to cause the first biasing mechanism 60 to press the swing guide 48 to the guide position, so that the link member 50 is disengaged from the swing guide 48.

Further, in the present embodiment, the guide engaging hole 52 (see FIG. 14) is provided on the opposite end of the link member 50 and the link engaging projection 48*d* (see FIG. 14) is provided on the swing guide 48, so as to engage the swing guide 48 and the opposite end of the link member 50 with each other. However, the guide engaging hole 52 may be provided on the swing guide 48 and the link engaging projection 48*d* on the link member 50, so as to engage the swing guide 48 and the opposite end of the link member 50 with each other.

Figure 26A:
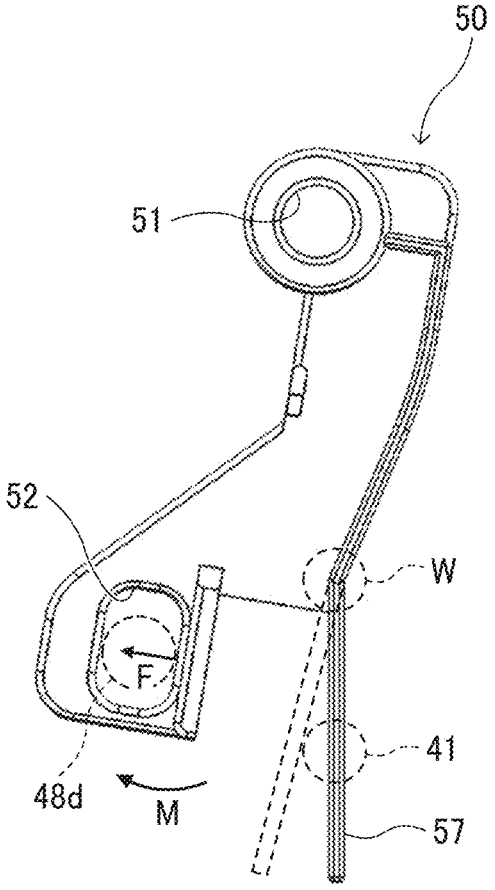
FIGS. 26A and 26B are diagrams illustrating the link member provided with a leaf spring.
Figure 26B:
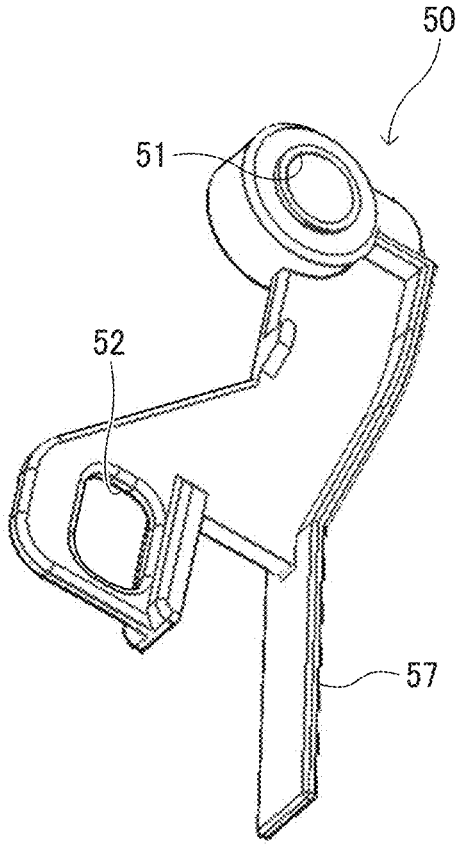

FIGS. 26A and 26B are diagrams illustrating the link member 50 provided with a leaf spring 57.

In the above-described configuration, the link member 50 and the first biasing mechanism 60 are provided separately. However, as illustrated in FIG. 26A, a leaf spring 57 may be provided on the link member 50 to have a configuration without the first biasing mechanism 60.

As illustrated in FIG. 26A, as the pressing member 41 presses the leaf spring 57, the leaf spring 57 deforms as indicated by a broken line in FIG. 26A. Due to the deformation of the leaf spring 57, the link member 50 obtains biasing force to rotate in a direction indicated by arrow M in FIG. 26A. Accordingly, force acts on the link engaging projection 48*d* that passes through the guide engaging hole 52 in a direction indicated by arrow F in FIG. 26A, so that the swing guide 48 is biased in the direction to rotate to the guide position.

By providing the leaf spring 57 on the link member 50 as an integrally molded resin part as illustrated in FIG. 26A, the configuration may omit the first biasing mechanism 60 (including the first pressing portion 61 and the first compression spring 62), thereby reducing the number of parts of the image forming apparatus 100. According to this configuration, a reduction in cost of the image forming apparatus 100 is achieved. On the other hand, in the configuration in which the leaf spring 57 is provided on the link member 50, stress is concentrated on a portion indicated by a broken line in FIG. 26A, which may cause damage on the link member 50. On the other hand, in the configuration in which the first biasing mechanism 60 is provided separately from the link member 50, the link member 50 is restrained from having the portion W on which stress is concentrated, which increases the durability of the link member 50. Further, the biasing force is managed easily.

Further, the second biasing mechanism 70 may be omitted by providing the leaf spring 57 on the end portion on the rear side of the swing guide 48.

Figure 27C:
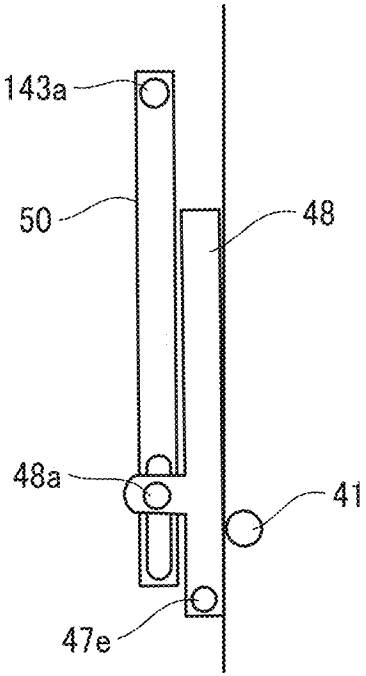
FIGS. 27A, 27B, and 27C are diagrams for explaining a case in which the swing guide rotates by an angle of 90 degrees.
Figure 27B:
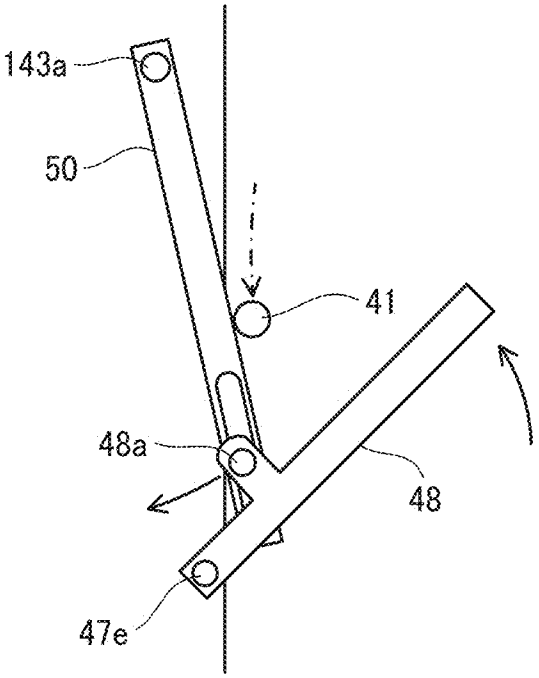
Figure 27A:
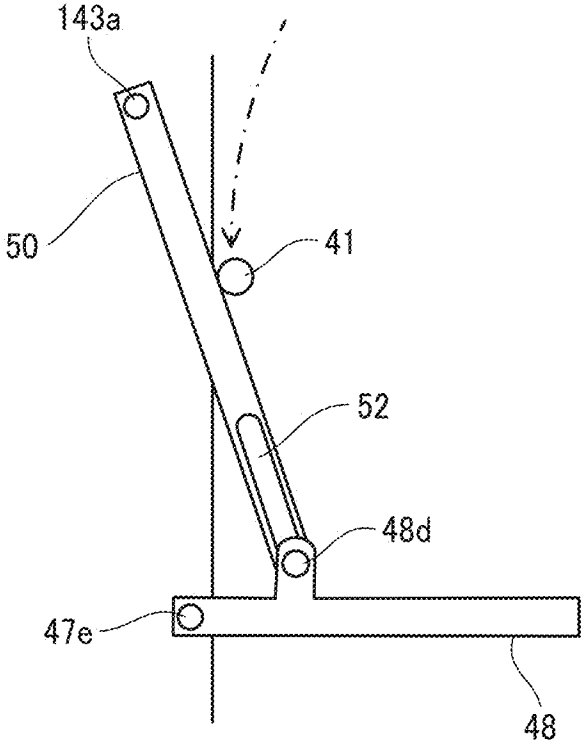

FIGS. 27A, 27B, and 27C are diagrams for explaining a case in which the swing guide 48 rotates by an angle of 90 degrees.

The swing guide 48 is configured to rotate from the guide position by an angle of 90 degrees. By so doing, as illustrated in FIG. 27A, the sheet conveyance passage from the sheet separation nip region to the pair of sheet conveyance rollers 39 is opened wider. According to this configuration, the sheet jammed in the sheet conveyance passage is removed easily. Also, in a case in which the swing guide 48 rotates by an angle of 90 degrees, the rotation fulcrum (the link retaining shaft 143*a*) of the link member 50 is provided at the upper position to separate from the rotation fulcrum (the swing shafts 47*e*) of the swing guide 48, so that the portion (the link engaging projection 48*d*) of the swing guide 48 where the swing guide 48 retains the opposite end of the link member 50 is provided at a position closer to the rotation fulcrum of the swing guide 48. By so doing, the swing guide 48 is moved from the retracted position to the guide position due to rotation of the link member 50.

However, while the swing guide 48 rotates from the retracted position for a certain amount, the link engaging projection 48*d* moves in the upper left direction. Therefore, the rotation of the link member 50 presses up the link engaging projection 48*d* in the guide engaging hole 52. Therefore, by applying grease to the inner circumferential surface of the guide engaging hole 52 or forming the link engaging projection 48*d* and the link member 50 by resin having low sliding resistance, the link engaging projection 48*d* smoothly moves in the guide engaging hole 52.

Further, for example, a torsion spring may be attached to the swing shafts 47*e* to bias the swing guide 48 in the rotational direction toward the guide position, so as to assist the swing guide 48 to rotate to the guide position. The biasing force of the torsion spring is less than the weight of the swing guide 48 so that the swing guide 48 in the retracted position does not rotate to the guide position by the biasing force of the torsion spring alone.

Further, the above-described example in the present embodiment is described to be applied to an electrophotographic image forming apparatus. However, this disclosure may be applied to an inkjet image forming apparatus.

This configuration according to the above-descried examples are not limited thereto. This disclosure can achieve the following aspects effectively.

Aspect 1.

In Aspect 1, a sheet guiding device (for example, the sheet guiding device 74) includes a cover unit (for example, the cover unit 130), a swing guide (for example, the swing guide 48), a link member (for example, the link member 50), and a contact member (for example, the pressing member 41). The cover unit is openably disposed on a housing (the printer 110) of an image forming apparatus (for example, the image forming apparatus 100). The swing guide is configured to move between a guide position at which the swing guide is open to guide a sheet (for example, the sheet P) and a retracted position at which the swing guide is closed. The swing guide is configured to move from the retracted position to the guide position along with closing movement of the cover unit. The link member has one end held by the housing and an opposite end engaged with the swing guide. The contact member is disposed on the cover unit and configured to contact the link member to rotate the link member in a closing movement of the cover unit.

Due to the settings of the retaining position of one end of the link member in the housing and the engaging position of the opposite end of the link member in the swing guide, the angle of the trajectory of movement of the opposite end of the link member and the rotational direction of the swing guide is smaller than the angle of the trajectory of movement of the contact member such as the pressing member 41 and the rotational direction of the swing guide such as the swing guide. For example, in a case in which the moving direction of the contact member to the link member is the direction perpendicular to the rotational direction of the swing guide, due to the positional change of the link member after the contact member has contacted the link member, the opposite end of the link member may move in the direction parallel to the rotational direction of the swing guide. As described above, by providing the link member, due to the positional change of the link member, the trajectory of movement of the opposite end of the link member may take a desired trajectory of movement different from the trajectory of movement of the contact member.

Accordingly, when the cover unit is closed, even though the image forming apparatus includes the cover unit having a configuration in which the trajectory of movement of the contact member near the swing guide is in the direction perpendicular to the rotational direction of the swing guide, due to the movement of the opposite end of the link member, the swing guide is smoothly rotated to the guide position along with the closing movement of the cover unit.

Aspect 2.

In Aspect 1, the contact member (for example, the pressing member 41) moves to contact the link member (for example, the link member 50) in a moving direction intersecting with a rotational direction of the swing guide (for example, the swing guide 48). After the contact member has contacted the link member to change a position of the link member, the opposite end of the link member is configured to move in a same direction as the rotational direction of the swing guide.

According to this configuration, as described in the embodiments above, even though the moving direction in which the contact member such as the pressing member 41 contacts the link member is the direction intersecting the rotational direction of the swing guide, due to the movement of the opposite end of the link member, the swing guide is rotated to the guide position smoothly along with the closing movement of the cover unit.

Aspect 3.

In Aspect 2, the one end of the link member (for example, the link member 50) is upstream from the opposite end of the link member in the moving direction of the contact member (for example, the pressing member 41).

According to this configuration, as described in the embodiment above, when the contact member such as the pressing member 41 contacts the link member to press the link member, the position of the link member may be changed so that the opposite end of the link member moves in the direction parallel to the rotational direction of the swing guide (for example, the swing guide 48).

Aspect 4.

In any one of Aspects 1 to 3, the link member (for example, the link member 50) has a contact face (the contact face 56) having a convex surface. The contact member (for example, the pressing member 41) is configured to contact the contact face of the link member.

According to this configuration, as described in the embodiments above, the amount of rotation of the link member with respect to the pressing amount of the contact member such as the pressing member 41 pressing the link member is reduced, and therefore the rotation speed of the link member is reduced. Accordingly, the rotation speed of the swing guide (for example, the swing guide 48) that rotates toward the guide position along with rotation of the link member is restrained. As a result, the rotation speed of the swing guide is restrained. Therefore, when the swing guide has reached the guide position, the swing guide is prevented from contacting the portion (for example, the contact face 149*a*, the contact face 47*d*) with great force.

Aspect 5.

In any one of Aspects 1 to 4, the sheet guiding device (for example, the sheet guiding device 74) further includes a biasing member (for example, the first biasing mechanism 60, the second biasing mechanism 70, the leaf spring 57) configured to bias the swing guide (for example, the swing guide 48) to position the swing guide at the guide position when the cover unit (for example, the cover unit 130) is closed.

According to this configuration, as described in the embodiments above, when the leading end of the sheet (for example, the sheet P) contacts the guide position (for example, the sheet feed guide 48*a* of the swing guide 48), the swing guide is stopped at the guide position, and therefore the sheet is guided reliably.

Aspect 6.

In Aspect 5, the swing guide (for example, the swing guide 48) is provided with a first biasing member (for example, the first biasing mechanism 60) at one end of the swing guide in an axial direction of the swing guide and a second biasing member (for example, the second biasing mechanism 70) at an opposite end of the swing guide in the axial direction of the swing guide.

According to this configuration, as described in the embodiments above, when the leading end of the sheet (for example, the sheet P) contacts the guide position (for example, the sheet feed guide 48*a* of the swing guide 48), the swing guide is prevented from inclining relative to the axial direction of the swing guide, and therefore the sheet is restrained from being skewed.

Aspect 7.

In Aspect 5 or Aspect 6, the biasing member (for example, the leaf spring 57) and the link member (for example, the link member 50) are made as an integrally molded resin part.

According to this configuration, as described with reference to FIG. 26, the number of components is reduced, and therefore a reduction in cost of the device is achieved.

Aspect 8.

In any one of Aspects 5 to 7, the biasing member (for example, the first biasing mechanism 60) is provided with a slider portion (for example, the first pressing portion 61) on which the contact member (for example, the pressing member 41) slides. The slider portion includes a sliding material.

According to this configuration, as described in the embodiments above, the cover unit (for example, the cover unit 130) is opened and closed smoothly.

Aspect 9.

In any one of Aspects 1 to 8, the swing guide (for example, the swing guide 48) is configured to guide the sheet (for example, the sheet P) to change a sheet conveyance direction (that is, a direction to convey the sheet).

According to this configuration, as described in the embodiments above, the leading end of the sheet that has been conveyed from the sheet separation nip region is highly likely to contact the guide portion (for example, the sheet feed guide 48*a*) of the swing guide. However, even if the leading end of the sheet contacts the guide portion, the biasing member (for example, the first biasing mechanism 60 and the second biasing mechanism 70) keeps the swing guide at the guide position. Accordingly, the sheet is guided to change the sheet conveyance direction of the sheet reliably.

Aspect 10.

In any one of Aspects 1 to 9, the sheet guiding guide (for example, the sheet guiding device 74) further includes a container (for example, the sheet tray 30) and a sheet feeder (for example, the sheet feeding device 47). The container is configured to contain a plurality of sheets. The sheet feeder is configured to feed a sheet (for example, the sheet P) of the plurality of sheets contained in the container. The swing guide (for example, the swing guide 48) is configured to guide the sheet that has immediately passed through the sheet feeder.

According to this configuration, by rotating the swing guide to the retracted position, the sheet jammed when feeding from the sheet feeder is removed easily.

Aspect 11.

An image forming apparatus (for example, the image forming apparatus 100) includes the sheet guiding device (for example, the sheet guiding device 74) of any one of Aspects 1 to 10. The sheet guiding device is configured to guide the sheet (for example, the sheet P).

According to this configuration, the swing guide (for example, the swing guide 48) is rotated along with the closing movement of the cover unit (for example, the cover unit 130).

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

What is claimed is:

1. A sheet guiding device comprising:

a cover unit configured to be openably disposed on a housing of an image forming apparatus;

a swing guide configured to move between a guide position at which the swing guide is open to guide a sheet and a retracted position at which the swing guide is closed, the swing guide configured to move from the retracted position to the guide position along with closing movement of the cover unit;

a link member having one end configured to be held by the housing and an opposite end engaged with the swing guide; and a contact member disposed on the cover unit, the contact member configured to contact the link member and move along a contact face of the link member to rotate the link member in the closing movement of the cover unit.

2. The sheet guiding device according to claim 1, wherein the contact member is configured to move to contact the link member in a moving direction intersecting with a rotational direction of the swing guide; and wherein, after the contact member has contacted the link member to change a position of the link member, the opposite end of the link member is configured to move in a same direction as the rotational direction of the swing guide.

3. The sheet guiding device according to claim 2, wherein the one end of the link member is upstream from the opposite end of the link member in the moving direction of the contact member.

4. The sheet guiding device according to claim 1, wherein the contact face has a convex surface.

5. The sheet guiding device according to claim 1, further comprising a biasing member configured to bias the swing guide to position the swing guide at the guide position when the cover unit is closed.

6. The sheet guiding device according to claim 5, wherein the swing guide is provided with a first biasing member at one end of the swing guide in an axial direction of the swing guide and a second biasing member at an opposite end of the swing guide in the axial direction of the swing guide.

7. The sheet guiding device according to claim 5, wherein the biasing member and the link member are molded as a single resin component.

8. The sheet guiding device according to claim 5, wherein the biasing member is provided with a slider portion on which the contact member is configured to slide, and wherein the slider portion includes a sliding material.

9. The sheet guiding device according to claim 1, wherein the swing guide is configured to guide the sheet to change a conveyance direction of the sheet.

10. The sheet guiding device according to claim 1, further comprising:

a container configured to contain a plurality of sheets; and a sheet feeder configured to feed a sheet of the plurality of sheets contained in the container, wherein the swing guide is configured to guide the sheet immediately after the sheet passes through the sheet feeder.

11. An image forming apparatus comprising:

the housing; and the sheet guiding device according to claim 1, the sheet guiding device configured to guide the sheet.

12. The sheet guiding device according to claim 1, wherein the link member is configured to rotate the swing guide based on being contacted by the contact member in the closing movement of the cover unit.

13. A sheet guiding device comprising:

a cover unit configured to be openably disposed on a housing of an image forming apparatus;

a swing guide configured to move between a guide position at which the swing guide is open to guide a sheet and a retracted position at which the swing guide is closed, the swing guide configured to move from the retracted position to the guide position along with closing movement of the cover unit;

a link member having one end configured to be held by the housing and an opposite end engaged with the swing guide;

a contact member disposed on the cover unit; and a biasing member configured to bias the swing guide to position the swing guide at the guide position when the cover unit is closed, the biasing member and the link member are molded as a single resin component, the contact member configured to contact the link member to rotate the link member in the closing movement of the cover unit.

14. The sheet guiding device according to claim 13, wherein the contact member is configured to move to contact the link member in a moving direction intersecting with a rotational direction of the swing guide; and wherein, after the contact member has contacted the link member to change a position of the link member, the opposite end of the link member is configured to move in a same direction as the rotational direction of the swing guide.

15. The sheet guiding device according to claim 14, wherein the one end of the link member is upstream from the opposite end of the link member in the moving direction of the contact member.

16. The sheet guiding device according to claim 13, wherein the link member has a contact face having a convex surface, and wherein the contact member is configured to contact the contact face of the link member.

17. A sheet guiding device comprising:

a cover unit configured to be openably disposed on a housing of an image forming apparatus;

a swing guide configured to move between a guide position at which the swing guide is open to guide a sheet and a retracted position at which the swing guide is closed, the swing guide configured to move from the retracted position to the guide position along with closing movement of the cover unit;

a link member having one end configured to be held by the housing and an opposite end engaged with the swing guide;

a contact member disposed on the cover unit; and a biasing member configured to bias the swing guide to position the swing guide at the guide position when the cover unit is closed, the biasing member is provided with a slider portion on which the contact member is configured to slide, and the slider portion includes a sliding material, the contact member configured to contact the link member to rotate the link member in the closing movement of the cover unit.

18. The sheet guiding device according to claim 17, wherein the contact member is configured to move to contact the link member in a moving direction intersecting with a rotational direction of the swing guide; and wherein, after the contact member has contacted the link member to change a position of the link member, the opposite end of the link member is configured to move in a same direction as the rotational direction of the swing guide.

19. The sheet guiding device according to claim 17, wherein the one end of the link member is upstream from the opposite end of the link member in the moving direction of the contact member.

20. The sheet guiding device according to claim 17, wherein the link member has a contact face having a convex surface, and wherein the contact member is configured to contact the contact face of the link member.

* * * * *